US008325004B2

(12) United States Patent
Nagano et al.

(10) Patent No.: US 8,325,004 B2
(45) Date of Patent: Dec. 4, 2012

(54) COMPOSITE TRANSFORMER

(75) Inventors: Masao Nagano, Saitama (JP); Satoshi Hashino, Saitama (JP); Mitsuaki Hirakawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/224,370

(22) Filed: Sep. 2, 2011

(65) Prior Publication Data

US 2012/0056704 A1 Mar. 8, 2012

(30) Foreign Application Priority Data

Sep. 3, 2010 (JP) ..... 2010-197415

(51) Int. Cl.
*H01F 17/04* (2006.01)
*H01F 27/24* (2006.01)
*H01F 27/28* (2006.01)

(52) U.S. Cl. ..... 336/221; 336/212; 336/216; 336/222

(58) Field of Classification Search ..... 336/212, 336/216, 221, 222
See application file for complete search history.

(56) References Cited

U.S. PATENT DOCUMENTS 3,175,175 A * 3/1965 Hauck ..... 336/175
4,864,478 A * 9/1989 Bloom ..... 363/16
5,376,912 A * 12/1994 Casagrande ..... 336/178
5,481,238 A * 1/1996 Carsten et al. ..... 336/214
6,972,657 B1 * 12/2005 Pacala et al. ..... 336/200
7,808,355 B2 * 10/2010 Nagano et al. ..... 336/182
7,839,255 B2 * 11/2010 Nagano et al. ..... 336/221

FOREIGN PATENT DOCUMENTS

JP 2005-224058 8/2005
JP 2009-284647 12/2009

* cited by examiner

*Primary Examiner* — Mohamad Musleh
*Assistant Examiner* — Joselito Baisa
(74) *Attorney, Agent, or Firm* — Squire Sanders (US) LLP

(57) ABSTRACT

A composite transformer includes: a transformer core including transformer-core legs; inductor cores including inductor-core legs; windings wound around the transformer-core legs and the inductor-core legs; the transformer core includes a pair of transformer bases connected to both ends of each of the transformer-core legs, and allows formation of closed magnetic circuits in the transformer core; each of the inductor cores includes one of the inductor-core legs, an outer core leg, and a pair of inductor bases connected to both ends of the one of the inductor-core legs and both ends of the outer core leg, and allows formation of a closed magnetic circuit in each inductor core; and the windings are wound in such directions that the magnetic fluxes produced in the transformer-core legs cancel each other in the closed magnetic circuits in the transformer core whichever of the windings is energized.

6 Claims, 12 Drawing Sheets

COMPOSITE TRANSFORMER

CROSS REFERENCE TO RELATED APPLICATION

This application claims the foreign priority benefit under 35 U.S.C. §119 of Japanese Patent Application No. 2010-197415, filed on Sep. 3, 2010, the disclosure of which is incorporated herein by reference.

BACKGROUND OF THE INVENTION

1. Field of the Invention

The present invention relates to a composite transformer (a combined type transformer), and more particularly to a composite transformer (a combined type transformer) which is downsized and causes a small magnetic energy loss.

2. Description of the Related Art

Conventionally, in the field of the electric-power conversion circuits such as DC-DC converters, various inventions have been made. (DC stands for direct current.)

For example, Japanese Patent Laid-open No. 2005-224058 discloses a DC-DC converter using a magnetic-field canceling transformer in which a plurality of windings are arranged so that the magnetic fluxes produced by the plurality of windings cancel each other. (Hereinafter, the magnetic-field canceling transformer may be simply referred to a transformer.) In addition, Japanese Patent Laid-open No. 2009-284647 (which is hereinafter referred to as JP2009-284647A) discloses as an improvement of the above magnetic-field canceling transformer a composite transformer in which a transformer and a buck-boost inductor are structurally integrated by using windings for the transformer and the buck-boost inductor in common.

However, in a magnetic-field canceling transformer according to a conventional technique, two windings are alternately wound around a central core leg as a portion of the transformer core. (See the central core leg 61a in FIGS. 2, 3, and 4 in JP2009-284647A.) Therefore, in the case where the wires of the two windings wound around the central core leg are also respectively wound around the inductor cores arranged on both sides of the central core leg, the windings protrude from the central core leg to both inductor-core sides of the central core leg. Further, if an attempt is made to arrange more than two windings around the central core leg, many physical constraints limit the layout, so that it is difficult to increase the number of windings to be arranged in parallel.

In addition, in the conventional composite transformer, the magnetic flux density in the central core leg around which the two windings are wound becomes so high as to exceed the saturation magnetic flux density of the transformer core, so that magnetic energy loss occurs.

Further, although the magnetic-field canceling transformer according to the conventional technique is downsized because of the common use of the windings as both of the inductor coils and the transformer coils, the conventional composite transformer is required to be further reduced in size because smaller composite transformers are more desirable.

The present invention has been developed in view of the above circumstances. The object of the present invention is to provide a composite transformer in which a plurality of windings are arranged in parallel, and the magnetic energy loss and the size can be reduced.

SUMMARY OF THE INVENTION

In order to accomplish the above object, the present invention provides a composite transformer including: a plurality of windings; a transformer core including a plurality of transformer-core legs which extend in a direction of axes of the plurality of windings and around which the plurality of windings are wound; a plurality of inductor cores including a plurality of inductor-core legs which extend in the direction of the axes of the plurality of windings, around which the plurality of windings are wound, and each of which is arranged adjacent to one of the plurality of transformer-core legs in a direction perpendicular to the direction of the axes of the plurality of windings. In the composite transformer: a plurality of core legs are formed with the plurality of transformer-core legs and the plurality of inductor-core legs and the plurality of windings are wound around the plurality of core legs in such a manner that magnetic fluxes are produced in the plurality of transformer-core legs and the plurality of inductor-core legs when current flows through the plurality of windings, and the plurality of core legs and the plurality of windings form a single transformer and a plurality of inductors; the plurality of transformer-core legs in the transformer core are arranged in an array in a direction perpendicular to the direction of the axes of the plurality of windings, the transformer core further includes a pair of transformer bases extending in the direction of the array and being opposed to each other and connected to both ends of each of the plurality of transformer-core legs in such a manner that closed magnetic circuits for magnetic fluxes produced in the plurality of transformer-core legs can be formed in the transformer core; each of the plurality of inductor cores includes one of the plurality of inductor-core legs, an outer core leg, and a pair of inductor bases, the outer core leg extends parallel to the one of the plurality of inductor-core legs in the direction of the axes of the plurality of windings and is arranged on an outer side of one of the plurality of windings wound around the one of the plurality of inductor-core legs, and the pair of inductor bases are connected to both ends of the one of the plurality of inductor-core legs and to both ends of the outer core leg in such a manner that a closed magnetic circuit for a magnetic flux produced in the one of the plurality of inductor-core legs can be formed in each of the plurality of inductor cores; and the plurality of windings are wound around the plurality of core legs in such directions that the magnetic fluxes produced in the plurality of transformer-core legs cancel each other in the closed magnetic circuits in the transformer core in any combination of directions that the magnetic fluxes produced.

In the composite transformer according to the present invention, when current is passed through one of the windings, a magnetic flux is produced in one of the core legs around which the one of the windings is wound. Since a closed magnetic circuit can be formed through one of the transformer-core legs constituting the one of the core legs in which the magnetic flux is produced and each of the other transformer-core leg or legs around which the other winding or windings are wound, electromagnetic induction occurs in the other winding or windings. At this time, the plurality of windings in the composite transformer are respectively wound around the plurality of core legs in such directions that the magnetic fluxes produced in the plurality of transformer-core legs cancel each other in the closed magnetic circuits in any combination of directions that the magnetic fluxes produced. Therefore, the electromagnetic induction occurs in such a manner that the voltage in each of the winding or windings other than the one of the windings through which the above current is passed is increased. That is, voltage transformation can be achieved in each of the other winding or windings.

In addition, since the plurality of windings in the composite transformer are respectively wound around the plurality of core legs in such directions that the magnetic fluxes produced in the plurality of transformer-core legs cancel each other in the closed magnetic circuits in any combination of directions that the magnetic fluxes produced, it is possible to reduce the remanent magnetic flux in the transformer core. On the other hand, magnetic fluxes are also produced in the inductor-core legs constituting the core legs, it is possible to store magnetic energy in each inductor core in which a closed magnetic circuit is formed.

As explained above, the present invention can provide a composite transformer in which a transformer and inductor cores are integrated.

Further, since the transformer-core legs are respectively arranged in correspondence with the plurality of windings in the composite transformer according to the present invention, it is possible to avoid occurrence of excessive magnetic flux density in the transformer-core legs. That is, the composite transformer according to the present invention can avoid excess of the magnetic flux density in the transformer-core legs over the saturation magnetic flux density of the transformer core, and can therefore avoid the magnetic energy loss due to the excessive magnetic flux density.

Furthermore, in the composite transformer according to the present invention, the magnetic paths constituting the closed magnetic circuits in the transformer core and extending in the direction of the axes of the plurality of windings are in the plurality of transformer-core legs (around which the plurality of windings are respectively wound). Therefore, no magnetic paths extending in the direction of the axes of the plurality of windings, other than the transformer-core legs, are required to be provided, although the conventional composite transformer needs core legs which do not pass through a winding (as the outer core leg 61b illustrated in FIGS. 3 and 4 in JP2009-284647A). Thus, the composite transformer according to the present invention can be realized in small size.

In the composite transformer according to the present invention, it is preferable that the plurality of windings have connection terminals connected to electrodes of an external electric circuit, and be formed and arranged in such a manner that the connection terminals of the plurality of windings are lead out to an identical side.

In the composite transformer having the above construction, the wires connected to the composite transformer can be arranged on one side of the composite transformer, so that it is possible to construct a DC-DC converter using the above composite transformer in small size.

It is preferable that the composite transformer according to the present invention further include a magnetic insulation sheet inserted between the transformer core and the plurality of inductor cores.

In the composite transformer having the magnetic insulation sheet as above, it is possible to prevent influence of a magnetic flux produced in each of the transformer core and the inductor cores on another of the transformer core and the inductor cores.

In the composite transformer according to the present invention, preferably, the transformer core is formed with an upper transformer-core member and a lower transformer-core member, the plurality of transformer-core legs are divided into upper parts and lower parts by a plane perpendicular to the direction of the axes of the plurality of windings, the upper transformer-core member is integrally formed with a first one of the pair of transformer bases arranged on an upper side and the upper parts of the plurality of transformer-core legs which are connected to the first one of the pair of transformer bases, and the lower transformer-core member is integrally formed with a second one of the pair of transformer bases arranged on a lower side and the lower parts of the plurality of transformer-core legs which are connected to the second one of the pair of transformer bases.

In the composite transformer having the above construction, the transformer core is formed with the two members of the upper transformer-core member and the lower transformer-core member, the number of parts constituting the transformer core is not changed even when the number of windings wound around the transformer-core legs is increased. That is, it is possible to avoid increase in the number of parts even when the number of windings increases.

In the composite transformer according to a preferable aspect of the present invention, the plurality of windings are a first winding and a second winding each of which is concentrically wound to form a cylindrically shape; the plurality of inductor cores are a first inductor core around which the first winding is wound and a second inductor core around which the second winding is wound; the plurality of transformer-core legs in the transformer core are a first transformer-core leg around which the first winding is wound and which has a semicylindrical shape and a second transformer-core leg around which the second winding is wound and which has a semicylindrical shape and extends parallel to the first transformer-core leg; the first inductor core includes a first inductor-core leg having a semicylindrical shape; the second inductor core includes a second inductor-core leg having a semicylindrical shape; a first core leg having a cylindrical shape is constituted by the first transformer-core leg and the first inductor-core leg which is arranged adjacent to the first transformer-core leg in a direction perpendicular to the direction of the axes of the plurality of windings; a second core leg having a cylindrical shape is constituted by the second transformer-core leg and the second inductor-core leg which is arranged adjacent to the second transformer-core leg in a direction perpendicular to the direction of the axes of the plurality of windings; and the first winding and the second winding are respectively wound around the first core leg and the second core leg in such a manner that a magnetic flux produced in the first transformer-core leg and a magnetic flux produced in the second transformer-core leg cancel each other in the closed magnetic circuits in the transformer core.

In the composite transformer having the above construction, for example, in the case where the pair of transformer bases have a rectangular shape viewed from the direction of the axes of the windings, and the first and second transformer-core legs are arranged on one side of the pair of transformer bases, the two inductor cores can be arranged on the one side of the pair of transformer bases. On the other hand, in the case where the first transformer-core leg is arranged on one of the opposed sides of the pair of transformer bases, and the second transformer-core leg is arranged on the other of the opposed sides of the pair of transformer bases, the inductor cores can be arranged on both sides of the transformer core. That is, the composite transformer having the above construction has a high degree of freedom in arrangement of the two inductor cores around the transformer core.

In the composite transformer according to a preferable aspect of the present invention, the plurality of windings are a first winding, a second winding, and a third winding each of which is wound to form a rectangular shape; the plurality of inductor cores are a first inductor core around which the first winding is wound, a second inductor core around which the second winding is wound, and a third inductor core around which the third winding is wound; the plurality of transformer-core legs in the transformer core are a first transformer-core leg around which the first winding is wound and which has a rectangular shape, a second transformer-core leg around which the second winding is wound and which has a rectangular shape and extends parallel to the first transformer-core leg, and a third transformer-core leg around which the third winding is wound and which has a rectangular shape and extends parallel to the first transformer-core leg; the first inductor core includes a first inductor-core leg having a rectangular shape; the second inductor core includes a second inductor-core leg having a rectangular shape; the third inductor core includes a third inductor-core leg having a rectangular shape; a first core leg having a prismatic shape is constituted by the first transformer-core leg and the first inductor-core leg which is arranged adjacent to the first transformer-core leg in a direction perpendicular to the direction of the axes of the plurality of windings; a second core leg having a prismatic shape is constituted by the second transformer-core leg and the second inductor-core leg which is arranged adjacent to the second transformer-core leg in a direction perpendicular to the direction of the axes of the plurality of windings; a third core leg having a prismatic shape is constituted by the third transformer-core leg and the third inductor-core leg which is arranged adjacent to the third transformer-core leg in a direction perpendicular to the direction of the axes of the plurality of windings; and the first winding, the second winding, and the second winding are respectively wound around the first core leg, the second core leg, and the third core leg in such a manner that a magnetic flux produced in the first transformer-core leg, a magnetic flux produced in the second transformer-core leg, and a magnetic flux produced in the third transformer-core leg cancel each other in the closed magnetic circuits in the transformer core.

In the composite transformer having the above construction, for example, in the case where the pair of transformer bases have a rectangular shape viewed from the direction of the axes of the windings, and the first to third transformer-core legs are arranged on one side of the pair of transformer bases, the three inductor cores can be arranged on the one side of the pair of transformer bases. Therefore, the composite transformer in which the three windings are arranged in parallel can be constructed in small size.

DETAILED DESCRIPTION OF THE PREFERRED EMBODIMENT

The composite transformers (the combined type transformer) according to the first and second embodiments of the present invention are explained below with reference to the accompanying drawings as needed. In addition, in the following explanations, identical or equivalent elements or constituents may be indicated by the same reference numbers through all the embodiments.

1. First Embodiment

1.1 Composite Transformer 1*a*

Figure 1A:
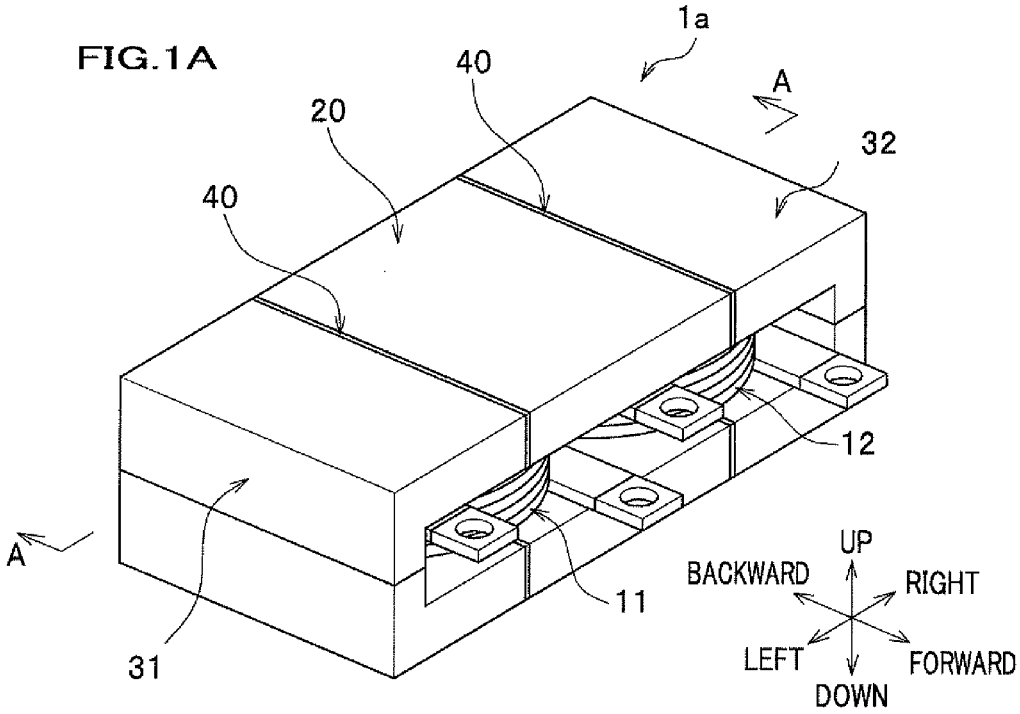
FIG. 1A is a perspective view, from upper left front, of a composite transformer according to a first embodiment of the present invention.
Figure 1B:
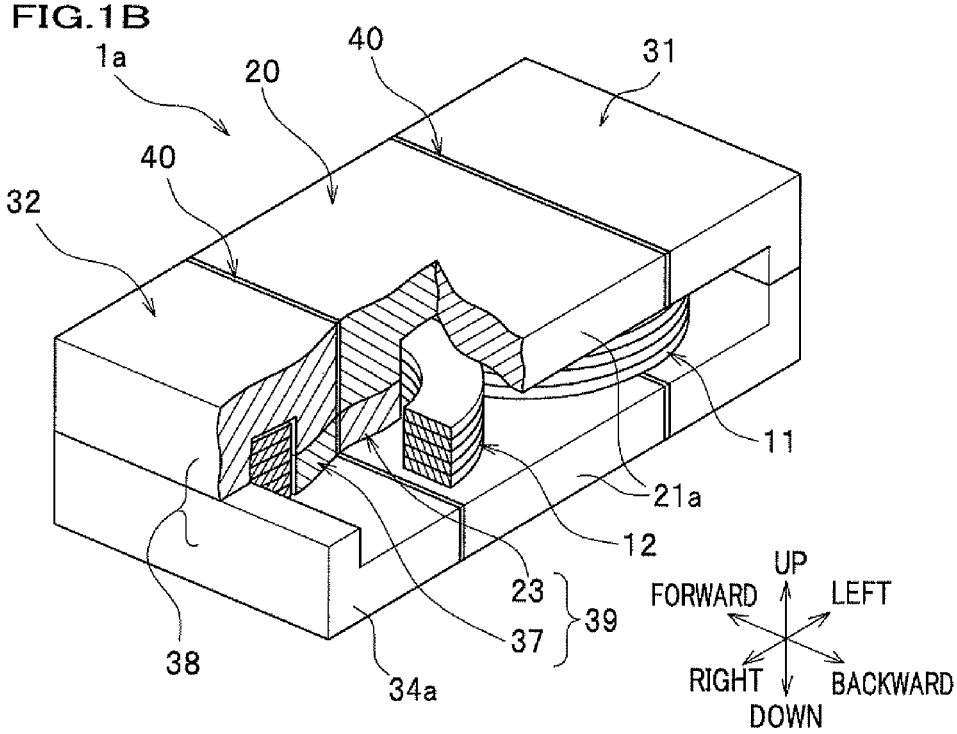
FIG. 1B is a partially cutaway perspective view, from upper right rear, of the composite transformer according to the first embodiment.

As illustrated in FIGS. 1A and 1B, the composite transformer 1*a* according to the first embodiment is a two-phase composite transformer which includes two windings 10 and in which a transformer and inductors are integrally arranged. In FIGS. 1A and 1B, the first winding constituting the two windings 10 and being arranged on the left side (viewed from front) is denoted by the reference 11, and the second winding constituting the two windings 10 and being arranged on the right side (viewed from front) is denoted by the reference 12.

Figure 2:
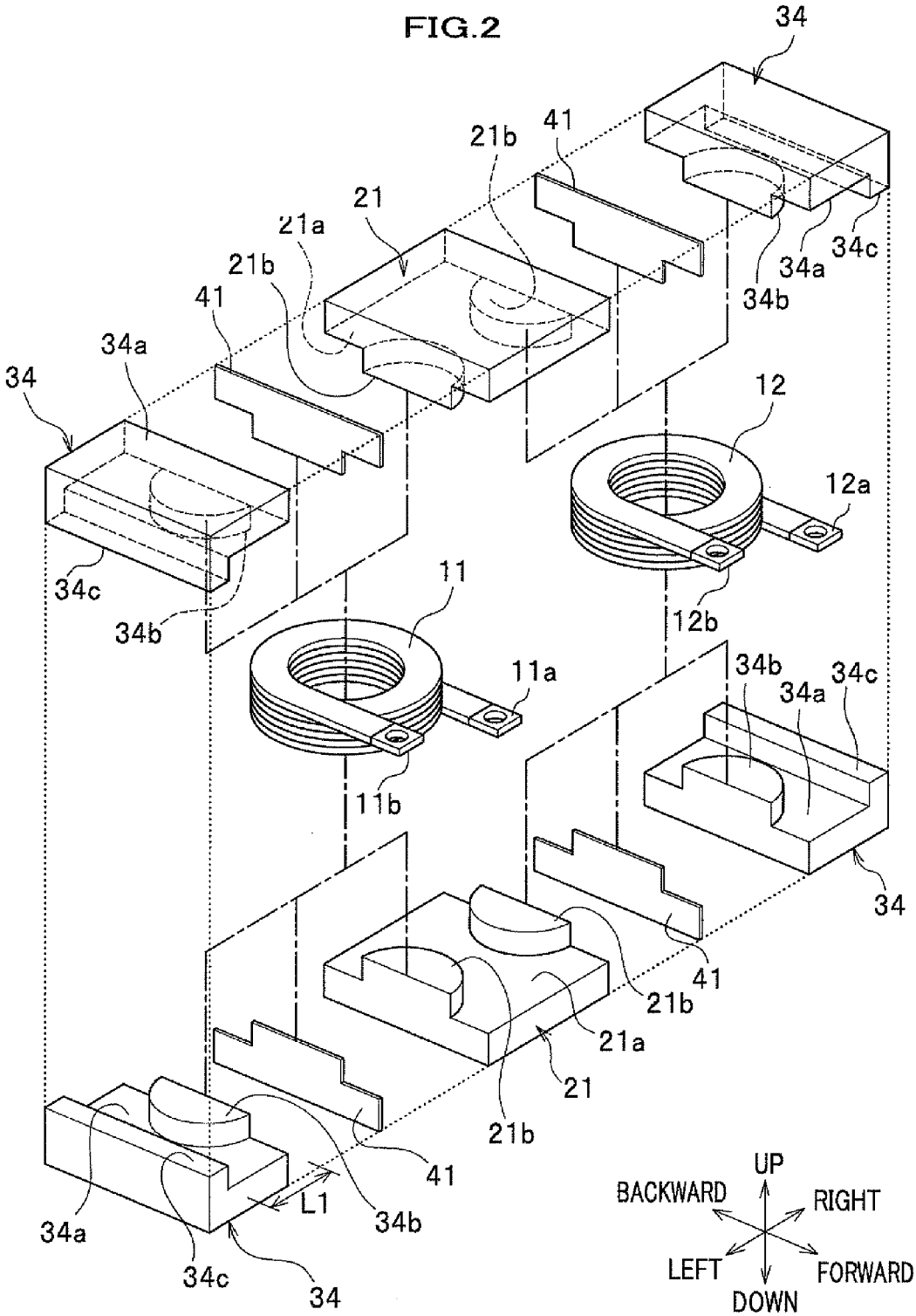
FIG. 2 is an exploded perspective view of the composite transformer illustrated in FIGS. 1A and 1B.

As illustrated in FIGS. 1A, 1B, and 2, the composite transformer 1*a* is constituted by the two windings 10, a transformer core 20 containing and supporting the two windings 10, two inductor cores 30 arranged on both sides of the transformer core 20, and two magnetic-insulation sheets 40 arranged between the transformer core 20 and the inductor cores 30.

1.2 Windings 10

The windings 10 are members each of which is connected to an external electric circuit, and converts the current supplied from the external electric circuit, into magnetic energy. As illustrated in FIG. 2, the first winding 11 and the second winding 12 constituting the windings 10 are each formed in an identical form. Specifically, the first and second windings 11 and 12 are coils in each of which an intermediate portion of a copper wire is concentrically wound to form a cylindrical shape. In addition, connection terminals 11*a*, 11*b*, 12*a*, and 12*b* are formed at both ends of the copper wires in the first and second windings 11 and 12. Further, core legs 39 are respectively inserted through the coils of the first and second windings 11 and 12 so that the first and second windings 11 and 12 are supported inside the transformer core 20.

The ends of the connection terminals 11*a* and 11*b* of the first winding 11 are lead out from the composite transformer 1*a* to an identical side, and the ends of the connection terminals 12*a* and 12*b* of the second winding 12 are also lead out from the composite transformer 1*a* to an identical side. The number of turns in the first winding 11 is equal to the number of turns in the second winding 12 although the number of turns is not specifically limited. The directions in which the first and second winding are respectively wound around the core legs 39 will be explained later after the transformer core 20 and the two inductor cores 30 are explained.

Hereinafter, the direction of the central axes around which the wires are wound in formation of the two windings 10 may be referred to as the direction of the winding axes or the vertical (up/down) direction. In the following explanations, the direction in which the two inductor cores 30 and the transformer core 20 are arrayed, which is perpendicular to the winding axes, is referred to as the left/right direction, and the direction perpendicular to the vertical direction and the left/right direction is referred to as the forward/backward direction.

1.3 Transformer Core 20

The transformer core 20 is a magnetic member which supports the two windings 10 and magnetically couples the two windings 10. As illustrated in FIG. 1B, the transformer core 20 includes transformer-core legs 23 and a pair of transformer bases 21*a*. The two windings 10 are respectively wound around the transformer-core legs 23 (although only one of the transformer-core legs 23 is partially illustrated in FIG. 1B). The transformer bases 21*a* are connected to both ends of each of the transformer-core legs 23 so as to support the transformer-core legs 23 and realize a closed magnetic circuit in the transformer core 20. That is, the transformer bases 21*a* and the transformer-core legs 23 are constituents of the transformer core 20 realizing the closed magnetic circuit.

Specifically, the transformer core 20 is formed by joining a pair of transformer-core members 21 having an identical shape as illustrated in FIG. 2. The pair of transformer-core members 21 are explained in detail below.

As illustrated in FIG. 2, each transformer-core member 21 is integrally formed with one of the transformer bases 21*a* and two transformer-core-leg portions 21*b*. Each transformer base 21*a* has a platelike shape. Each transformer-core-leg portion 21*b* has a semicylindrical shape, and is formed on a flat surface of each transformer base 21*a*.

As illustrated in FIG. 2, each transformer base 21*a* having the platelike shape has a flat surface on each of the upper and lower sides. In addition, as illustrated in FIG. 3, each transformer base 21*a* is formed to have the dimension of the flat surface in the forward/backward direction greater than the outer diameter of the windings 10 and the dimension of the flat surface in the left/right direction approximately equal to the outer diameter of the windings 10.

When, as illustrated in FIG. 2, the two windings 10 are arranged adjacent to each other in the left/right direction, and the transformer-core members 21 are arranged above and under the two windings 10 to be opposed to each other in the vertical direction, it is possible to make the halves of the respective windings 10 exposed from the left and right edges of the transformer core 20.

Figure 3:
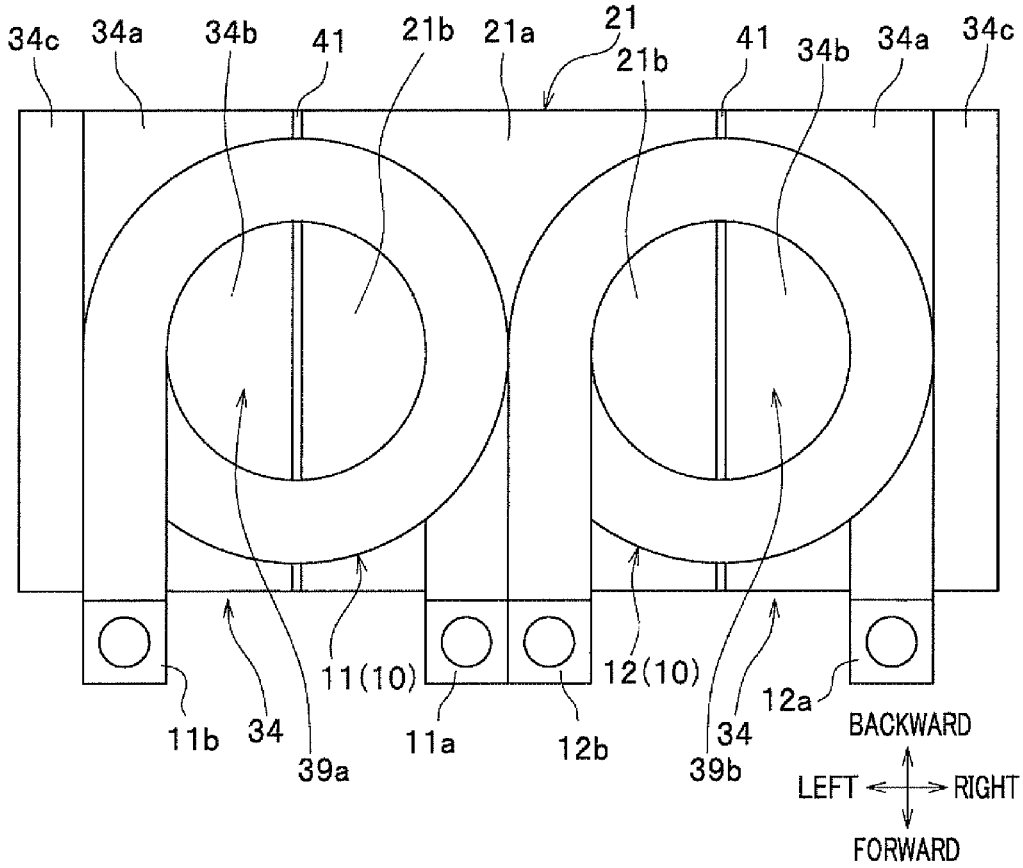
FIG. 3 is a top view of a portion of the composite transformer according to the first embodiment, where the transformer-core members and inductor-core members which are arranged at the top are removed for illustration.
Figure 4:
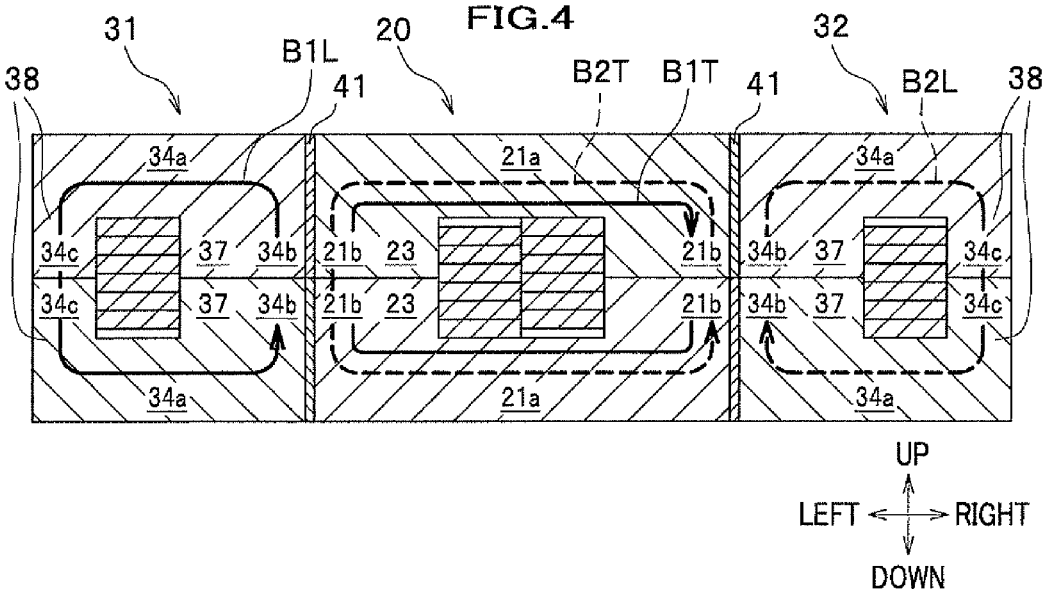
FIG. 4 is a cross-sectional view of the composite transformer illustrated in FIGS. 1A and 1B at the cross section A-A.

The transformer-core-leg portions 21*b* are elements for constituting the transformer-core legs 23, and each of the transformer-core-leg portions 21*b* is formed as an extension of one of the transformer bases 21*a* in contact with a central portion of one of the left and right sides of the flat surface of the one of the transformer bases 21*a* so as to have a semicylindrical shape (i.e., a semicircular shape in a cross-sectional view) as illustrated in FIGS. 2 and 3. The diameter of the semicircular shape in the cross-sectional view is explained later. In addition, each transformer-core-leg portions 21*b* is formed to have the dimension in the vertical direction approximately half of the dimension of the windings 10 in the direction of the winding axis as illustrated in FIG. 4.

The transformer core 20 can be formed by arranging the pair of transformer-core members 21 to be opposed to each other in the vertical direction in such positions that the top surfaces of the transformer-core-leg portion 21*b* formed on one of the transformer bases 21*a* are opposed to the top surfaces of the transformer-core-leg portion 21*b* formed on the other of the transformer bases 21*a*, making the opposed top surfaces of the transformer-core-leg portions 21*b* abut each other, and joining the transformer-core-leg portions 21*b*. Thus, the transformer-core legs 23 having the semicylindrical shape can be formed with the transformer-core-leg portions 21*b*. In addition, since the transformer-core legs 23 have the length approximately equal to the dimension of the two windings 10 in the vertical direction, the two windings 10 wound around the transformer-core legs 23 can be supported by the transformer bases 21*a* located above and under the transformer-core legs 23.

Further, the magnetic material used for forming the transformer core 20 preferably has high saturation magnetic flux density (which can be measured in tesla (T)) and a small loss (which can be measured in W/kg). The two windings 10 produce in the transformer core 20 magnetic fluxes in mutually cancelling directions. Therefore, the remanent magnetic flux density can be reduced. (The magnetic fluxes produced in the transformer core 20 by the two windings 10 are explained later.) Consequently, the smallness of the core loss precedes the highness of the saturation magnetic flux density in the magnetic material used for forming the transformer core 20. For example, the magnetic material used for forming the transformer core 20 may be a Mn—Zn ferrite, a nanocrystalline alloy, an iron-based amorphous material, a cobalt-based amorphous material, or the like.

1.4 Inductor Cores 30

The two inductor cores 30 are magnetic members for storing the magnetic energy of the magnetic fluxes produced by the two windings 10. As illustrated in FIGS. 1A and 1B, each of the two inductor cores 30 includes an inductor-core leg 37, an outer core leg 38, and a pair of inductor bases 34*a*. As illustrated in FIG. 4, the inductor-core leg 37, the outer core leg 38, and the pair of inductor bases 34*a* are constituents of each of the two inductor cores 30 realizing a closed magnetic circuit.

As illustrated in FIGS. 1A and 1B, the composite transformer 1*a* includes the two inductor cores 30 which are arranged on both sides of the transformer core 20.

The structures of the two inductor cores 30 are explained below. In the following explanations, The inductor core 30 arranged on the left side of the transformer core 20 is referred to as the left inductor core 31, and the inductor core 30 arranged on the right side of the transformer core 20 is referred to as the right inductor core 32. In addition, the two inductor cores 30 have an identical shape. Therefore, only the left inductor core 31 is explained below, and the explanation on the right inductor core 32 is omitted.

As illustrated in FIG. 2, the left inductor core 31 is formed with a pair of inductor-core members 34. As illustrated in FIGS. 1A, 1B, and 3, the left inductor core 31 can be formed by making the inductor-core members 34 opposed to each other in such a manner that the top surfaces of an inductor-core-leg portion 34*b* and an outer-core-leg portion 34*c* formed on one of the inductor bases 34*a* are opposed to the top surfaces of an inductor-core-leg portion 34*b* and an outer-core-leg portion 34*c* formed on the other of the inductor bases 34*a*, and joining the inductor-core members 34.

As illustrated in FIG. 2, each inductor-core members 34 is integrally formed with one of the inductor bases 34*a*, the inductor-core-leg portion 34*b*, and the outer-core-leg portion 34*c*. Each inductor base 34*a* has a platelike shape. The inductor-core-leg portion 34*b* and the outer-core-leg portion 34*c* are formed on a flat surface of each of the inductor base 34*a*.

As illustrated in FIG. 2, each inductor bases 34*a* having the platelike shape has a flat surface on each of the upper and lower sides. In addition, each inductor bases 34*a* is formed to have the dimension of the flat surface in the forward/backward direction equivalent to the dimension of the flat surface of the transformer bases 21*a* in the forward/backward direction. Further, the dimension L1 (indicated in FIG. 2) in the left/right direction of the portion of the inductor bases 34*a* excluding the portion of the inductor bases 34*a* on which the outer-core-leg portion 34*c* is formed is equal to the outer radius of one of the windings 10. Thus, the aforementioned halves of the two windings 10 exposed from the left and right edges of the transformer core 20 can be enclosed in the two inductor cores 30 as illustrated in FIG. 3.

The inductor-core-leg portions 34*b* and the outer-core-leg portions 34*c* (in the inductor-core members 34 constituting the left inductor core 31) are explained below.

As illustrated in FIG. 2, the inductor-core-leg portion 34*b* constituting each inductor-core member 34 is formed as an extension of one of the inductor bases 34*a* constituting the inductor-core member 34 in contact with a central portion of the right side of the flat surface of the one of the inductor bases 34*a* so as to have a semicylindrical shape (i.e., a semicircular shape in a cross-sectional view) as illustrated in FIG. 2. The diameter of the semicircular shape of the inductor-core-leg portion 34*b* will be explained later.

In addition, the outer-core-leg portion 34*c* constituting each inductor-core member 34 is formed as an extension of one of the inductor bases 34*a* constituting the inductor-core member 34 in contact with the left side of the flat surface of the one of the inductor bases 34*a* so as to have a platelike shape (i.e., a rectangular shape in a cross-sectional view) as illustrated in FIG. 2.

The left inductor core 31 can be formed by arranging the inductor-core members 34 to be opposed to each other in such positions that the inductor-core-leg portions 34*b* in the inductor-core members 34 are on the right side, and the outer-core-leg portions 34*c* in the inductor-core members 34 are on the left side, and the top surfaces of the inductor-core-leg portion 34*b* and the outer-core-leg portion 34*c* formed on one of the inductor bases 34*a* are respectively opposed to the top surfaces of the inductor-core-leg portion 34*b* and the outer-core-leg portion 34*c* formed on the other of the inductor bases 34*a*, and joining the top surfaces of the inductor-core-leg portions 34*b* (on the right side) and the top surfaces of the outer-core-leg portions 34*c* (on the left side) in the inductor-core members 34. Thus, the inductor-core leg 37 (having the semicylindrical shape) is formed between the inductor bases 34*a* in contact with the central portions of the right sides of the inductor bases 34*a*, and the outer core leg 38 (having the platelike shape) is formed between the inductor bases 34*a* in contact with the central portions of the left sides of the inductor bases 34*a*. The inductor-core leg 37 and the outer core leg 38 extend in parallel. One of the windings 10 is wound the inductor-core leg 37, and no winding is wound around the outer core leg 38.

The left inductor core 31 is joined to the transformer core 20 at the right edge of the left inductor core 31, where the inductor-core leg 37 is formed in contact with the central portion of the right edge of the left inductor core 31. Thus, when the left inductor core 31 is joined to the transformer core 20, the inductor-core leg 37 is arranged adjacent to one of the transformer-core legs 23 which is formed in contact with the central portion of the left edge of the transformer core 20, where one of the magnetic-insulation sheets 40 (explained later) is arranged (inserted) between the transformer core 20 and the left inductor core 31. The inductor-core leg 37 and the adjacent transformer-core leg 23 constitute one of the core legs 39. Although the core legs 39 are respectively formed on the left and right sides of the transformer core 20, hereinafter, the one of the core legs 39 formed on the left side of the transformer core 20 is referred to as the first core leg 39*a*, and the other of the core legs 39 formed on the right side of the transformer core 20 is referred to as the second core leg 39*b*.

The inductor-core-leg portions 34*b* constituting the inductor-core leg 37 and the transformer-core-leg portions 21*b* constituting the adjacent transformer-core leg 23 are formed so that the core leg 39 has a diameter approximately equal to the inner diameter of the winding 10 when one of the magnetic-insulation sheets 40 is inserted between the inductor-core leg 37 and the adjacent transformer-core leg 23. That is, the core leg 39 constituted by the inductor-core leg 37 and the transformer-core leg 23 has the diameter approximately equal to the inner diameter of the winding 10 when the magnetic-insulation sheets 40 is inserted between the inductor-core leg 37 and the transformer-core legs 23, so that the winding 10 can be wound around the core legs 39.

Each inductor-core-leg portion 34*b* is arranged to have a dimension in the vertical direction approximately half the dimension of the winding 10 in the axis direction. Therefore, the inductor-core leg 37 constituted by the two inductor-core-leg portions 34*b* has the length approximately equal to the dimension of the winding 10 in the axis direction, so that the winding 10 wound around the inductor-core leg 37 can be supported by the inductor bases 34*a* which respectively exist above and below the inductor-core leg 37.

The magnetic material used for forming the two inductor cores 30 preferably has high saturation magnetic flux density (which can be measured in tesla (T)) and a small loss (which can be measured in W/kg). The magnetic fluxes produced in the inductor cores 30 are mainly leakage fluxes. Therefore, the lowness of the saturation magnetic flux density precedes the largeness of the core loss. For example, the magnetic material used for forming the inductor cores 30 may be permalloy dust, iron dust, silicon steel dust, a silicon steel plate, or the like.

1.5 Magnetic-Insulation Sheet 40

The magnetic-insulation sheets 40 are sheet members having low magnetic permeability, and provided for preventing influence of a magnetic flux produced in each of the transformer core 20 and the inductor cores 30 on another of the transformer core 20 and the inductor cores 30. As illustrated in FIG. 2, each of the magnetic-insulation sheets 40 is constituted by two magnetic-insulation-sheet members 41 each having a steplike shape (in a front view) in which a central portion has a relatively great dimension in the vertical direction as illustrated in FIG. 2. Each of the two magnetic-insulation-sheet members 41 is arranged between each of the transformer-core members 21 and the adjacent one of the inductor-core members 34. The insertion of the magnetic-insulation-sheet members 41 between each transformer-core members 21 and the adjacent inductor-core member 34 enables magnetic insulation between each transformer-core members 21 and the adjacent inductor-core member 34.

1.6 Arrangement of Windings 10 Around Core Legs 39

The winding around the core legs 39 is explained below. As illustrated in FIG. 3, the first and second windings 11 and 12 are respectively wound around the first and second core legs 39*a* and 39*b* in such a manner that the connection terminals 11*a* and 11*b* of the first winding 11 and the connection terminals 12*a* and 12*b* of the second winding 12 are lead out from the composite transformer 1*a* to the front (forward) side. That is, both of the first and second windings 11 and 12 can be lead out from the composite transformer 1*a* to the identical side.

In addition, the first and second windings 11 and 12 are wound around the first and second core legs 39*a* and 39*b* so that the first and second windings 11 and 12 produce in the closed magnetic circuit in the transformer core 20 magnetic fluxes in mutually cancelling directions. For example, in the case where the connection terminal 11*a* of the first winding 11 and the connection terminal 12*a* of the second winding 12 are connected to a positive electrode, and the connection terminal 11*b* of the first winding 11 and the connection terminal 12*b* of the second winding 12 are connected to a negative electrode, the first and second windings 11 and 12 are wound clockwise around the first and second core legs 39*a* and 39*b* as illustrated in FIGS. 2 and 3.

In the following explanations, the magnetic flux produced in the first core leg 39*a* when current flows through the first winding 11 wound around the first core leg 39*a* is denoted by B1, the magnetic flux produced in the transformer core 20 as a portion of the magnetic flux B1 is denoted by B1T, and the magnetic flux produced in the left inductor core 31 as a portion of the magnetic flux B1 is denoted by B1L. In addition, the magnetic flux produced in the second core leg 39*b* when current flows through the second winding 12 wound around the second core leg 39*b* is denoted by B2, the magnetic flux produced in the transformer core 20 as a portion of the magnetic flux B2 is denoted by B2T, and the magnetic flux produced in the right inductor core 32 as a portion of the magnetic flux B2 is denoted by B2L.

As illustrated in FIG. 4, the direction of the magnetic flux B1T produced in the transformer core 20 by the first winding 11 is clockwise viewed from front. On the other hand, the direction of the magnetic flux B2T produced in the transformer core 20 by the second winding 12 is anticlockwise viewed from front. That is, the magnetic fluxes B1T and B2T produced in the transformer core 20 by the first and second windings 11 and 12 are in mutually canceling directions.

1.7 Operations of Composite Transformer 1*a*

The operations of the composite transformer 1*a* are explained below.

First, the operations of the composite transformer 1*a* initiated by a current flow through the first winding 11 are explained below.

When current is passed through the first winding 11 from the connection terminal 11*a* to the connection terminal 11*b*, the magnetic flux B1 is produced in the first core leg 39*a* (around which the first winding 11 is wound) as illustrated in FIG. 4.

The magnetic flux B1T which is produced in the transformer-core leg 23 located on the left side in the transformer core 20 is in the upward direction, and extends through the transformer base 21*a* located on the upper side to the transformer-core leg 23 located on the right side. Since the magnetic flux B1T in the transformer-core leg 23 located on the right side is in the downward direction, the magnetic flux B1T passes through the transformer base 21*a* located on the lower side, and returns to the transformer-core leg 23 located on the left side. That is, a circuit of the magnetic flux B1T is realized in the transformer core 20.

Since the magnetic flux B1T passes through the transformer-core leg 23 on the right side, electromagnetic induction occurs in the second winding 12, which is wound around the transformer-core legs 23 on the right side. Therefore, the second winding 12 is boosted. Specifically, current flows through the second winding 12 in the direction from the connection terminal 12*a* (connected to the positive electrode) to the connection terminal 12*b* (connected to the negative electrode).

Next, the magnetic flux B1L produced in the inductor-core leg 37 in the left inductor core 31 (around which the first winding 11 is wound) is explained below. As illustrated in FIG. 4, the magnetic flux B1L produced in the inductor-core leg 37 is in the upward direction, and passes through the inductor bases 34*a* located on the upper side, the outer core leg 38, and the inductor bases 34*a* located on the lower side to the inductor-core leg 37. That is, a circuit of the magnetic flux B1L is realized in the left inductor core 31.

As long as current flows through the first winding 11, the magnetic flux is produced in the left inductor core 31, i.e., magnetic energy is stored in the left inductor core 31. That is, the first winding 11 and the left inductor core 31 carry out the function of an inductor.

Next, the operations of the composite transformer 1*a* initiated by a current flow through the second winding 12 are explained below.

When current is passed through the second winding 12 from the connection terminal 12*a* to the connection terminal 12*b*, the magnetic flux B2T is produced in the first core leg 39*b* (around which the second winding 12 is wound) as illustrated in FIG. 4.

The magnetic flux B2T which is produced in the transformer-core leg 23 located on the right side in the transformer core 20 is in the upward direction, and extends to the transformer-core legs 23 located on the left side through the transformer base 21*a* located on the upper side. Since the magnetic flux B2T in the transformer-core legs 23 on the left side is in the downward direction, the magnetic flux B2T passes through the transformer base 21*a* located on the lower side, and returns to the transformer-core leg 23 located on the right side. Thus, the magnetic flux B2T circulates in the transformer core 20.

Since the magnetic flux B2T passes through the transformer-core leg 23 on the left side, electromagnetic induction occurs in the second winding 12, which is wound around the transformer-core legs 23 on the left side. Therefore, the first winding 11 is boosted. Specifically, current flows through the first winding 11 in the direction from the connection terminal 11*a* (connected to the positive electrode) to the connection terminal 11*b* (connected to the negative electrode).

Next, the magnetic flux B2L produced in the inductor-core leg 37 in the right inductor core 32 (around which the second winding 12 is wound) is explained below. As illustrated in FIG. 4, the magnetic flux B2L produced in the inductor-core leg 37 is in the upward direction, and extends through the inductor bases 34*a* located on the upper side to the outer core leg 38. Since the magnetic flux B2L in the outer core leg 38 is in the downward direction, the magnetic flux B2L passes through the inductor bases 34*a* located on the lower side, and returns to the inductor-core leg 37. Thus, the magnetic flux B2L circulates in the left inductor core 31.

As long as current flows through the second winding 12, the magnetic flux is produced in the right inductor core 32, i.e., magnetic energy is stored in the right inductor core 32. That is, the second winding 12 and the right inductor core 32 carry out the function of an inductor.

1.8 Advantages of First Embodiment

The composite transformer 1*a* according to the first embodiment has the following advantages.

(1) Since the direction of the magnetic flux B1T produced in the transformer core 20 by the first winding 11 is opposite to the direction of the magnetic flux B2T produced in the transformer core 20 by the second winding 12, it is possible to reduce the remanent magnetic flux in the transformer core 20, and prevent the magnetic saturation in the transformer core 20. In particular, the remanent magnetic flux (especially, the DC magnetic flux) can be reduced.

(2) Since the transformer-core legs 23 are respectively provided in correspondence with the two windings 10, it is possible to prevent excess of the magnetic flux densities in the transformer-core legs 23. That is, it is possible to avoid the situation in which the magnetic flux density realized by the magnetic fluxes B1T and B2T produced by the two windings 10 exceeds the saturation magnetic flux density of the transformer core 20 and causes a magnetic energy loss.

(3) The magnetic paths constituting the closed magnetic circuit in the transformer core 20 and extending in the direction of the axes of the two windings 10 are in the two transformer-core legs 23 (around which the two windings 10 are respectively wound). Therefore, no magnetic paths extending in the direction of the axes of the two windings 10, other than the transformer-core legs 23, are required to be provided, so that the composite transformer 1*a* can be realized in small size.

(4) The connection terminals 11*a* and 11*b* of the first winding 11 and the connection terminals 12*a* and 12*b* of the second winding 12 are lead out from the composite transformer 1*a* in the identical direction, and arranged on the front (forward) side. Therefore, it is possible to arrange the wires connected to the composite transformer 1*a*, on one side of the composite transformer 1*a*, and realize a DC-DC converter using the composite transformer 1*a* in small size.

(5) Since the transformer core 20 is formed with the two transformer-core members 21, the number of parts constituting the transformer core 20 is not changed even when the number of windings wound around the transformer-core legs 23 is increased. That is, it is possible to avoid increase in the number of parts even when the number of windings increases.

2. Second Embodiment

The present invention is not limited to the composite transformer 1*a* according to first embodiment. For example, the present invention can also include the composite transformer 1*b* according to the second embodiment, which is a three-phase composite transformer having three windings. The composite transformer 1*b* according to the second embodiment is explained below with reference to FIGS. 5 to 10.

2.1 Composite Transformer 1*b*

Figure 5:
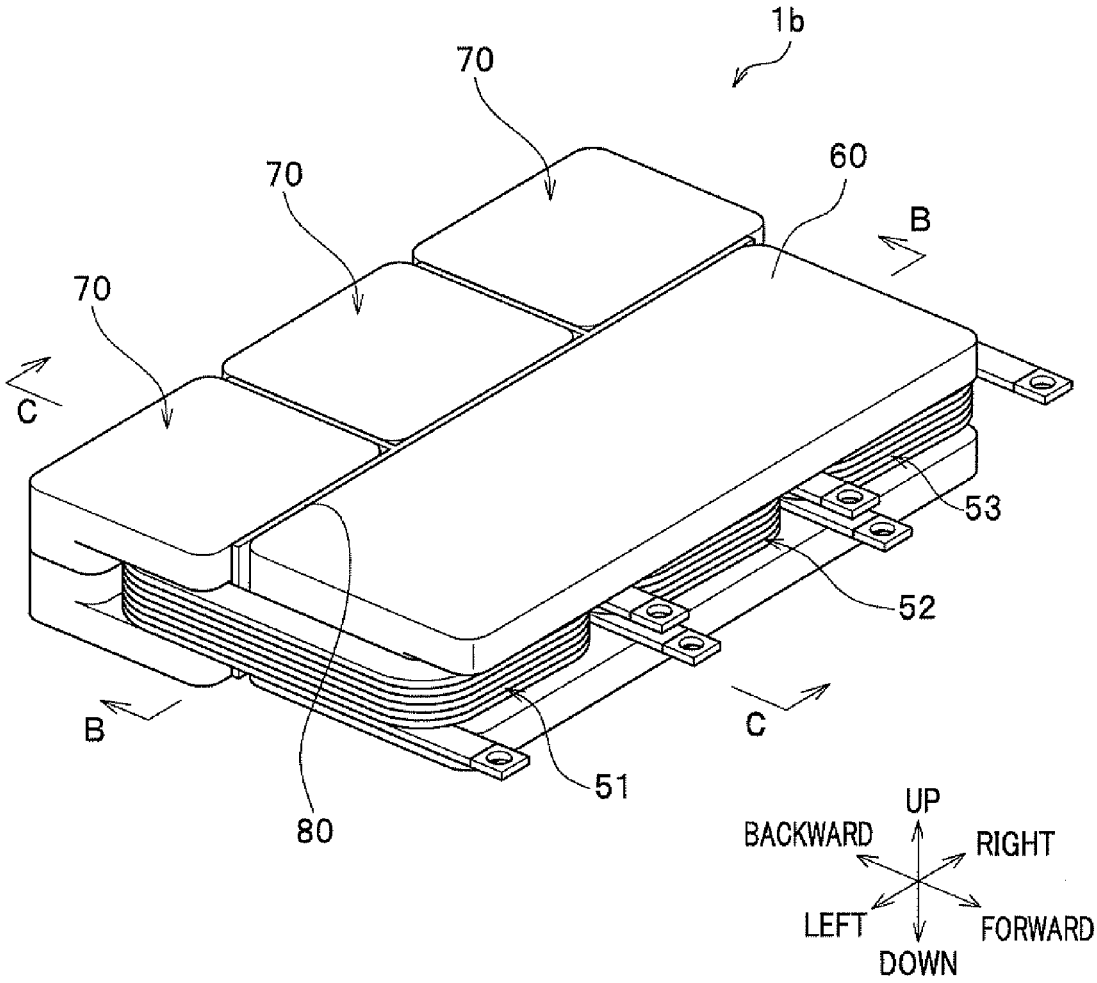
FIG. 5 is a perspective view of a composite transformer according to a second embodiment of the present invention.

As illustrated in FIG. 5, the composite transformer 1*b* according to the second embodiment is a three-phase composite transformer which includes three windings 50, a transformer core 60, three inductor cores 70, and a magnetic-insulation sheet 80 and in which a transformer and inductors are integrally arranged. That is, the number of the windings 50 in the composite transformer 1*b* according to the second embodiment is greater than the number of the windings 10 in the composite transformer 1*a* according to the first embodiment.

Figure 10:
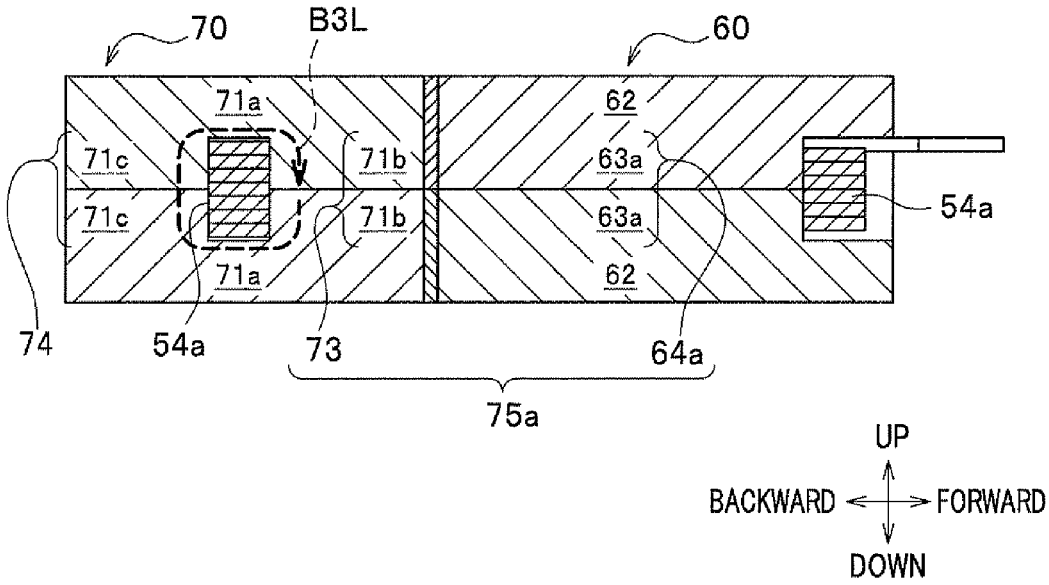
FIG. 10 is a cross-sectional view of the composite transformer illustrated in FIG. 5 at the cross section C-C.

As the two windings 10 in the composite transformer 1*a* according to the first embodiment, the three windings 50 are wound around core legs 75, each of which is constituted by a transformer-core leg 64 and an inductor-core leg 73 as illustrated in FIG. 10.

However, in order to accommodate the increased number of windings in the transformer core 60, the composite transformer 1*b* according to the second embodiment is differentiated from the composite transformer 1*a* in the shapes of the three windings 50, the shapes of the core legs 75 (around which the three windings 50 are respectively wound), and the arrangement and the positions of the transformer core 60 and the three inductor cores 70. Specifically, each of the windings in the composite transformer 1*b* has a rectangular shape viewed from the direction of the axes of the windings, where the long sides of the rectangular windings are in the forward/backward direction.

Hereinbelow, the construction of the composite transformer 1*b* according to the second embodiment is explained in detail, where the explanations are focused on the differences from the composite transformer 1*a* according to the first embodiment.

2.2 Windings 50

The three windings 50 are constituted by the first, second, and third windings 51, 52, and 53, which are arranged in this order in the direction from the left to the right in the transformer core 60 as illustrated in FIG. 5. In addition, as mentioned before and illustrated in FIGS. 6 to 8, each of the windings 50 is a coil having a rectangular shape viewed from the direction of the axes of the windings, and the long sides of the rectangular windings are in the forward/backward direction. That is, the dimension of each of the windings 50 in the left/right direction is small. Therefore, even after the three windings 50 are arrayed in the left/right direction, the total dimension of the array of the three windings 50 in the left/right direction can be suppressed. In addition, since the dimension of the windings 50 in the forward/backward direction is great, it is possible to avoid reduction of the internal area of each of the three windings 50, and therefore avoid reduction of the magnetic fluxes produced by the three windings 50. The winding directions of the first, second, and third windings 51, 52, and 53 will be explained after the structure of the transformer core 60 is explained.

2.3 Transformer Core 60

Figure 6:
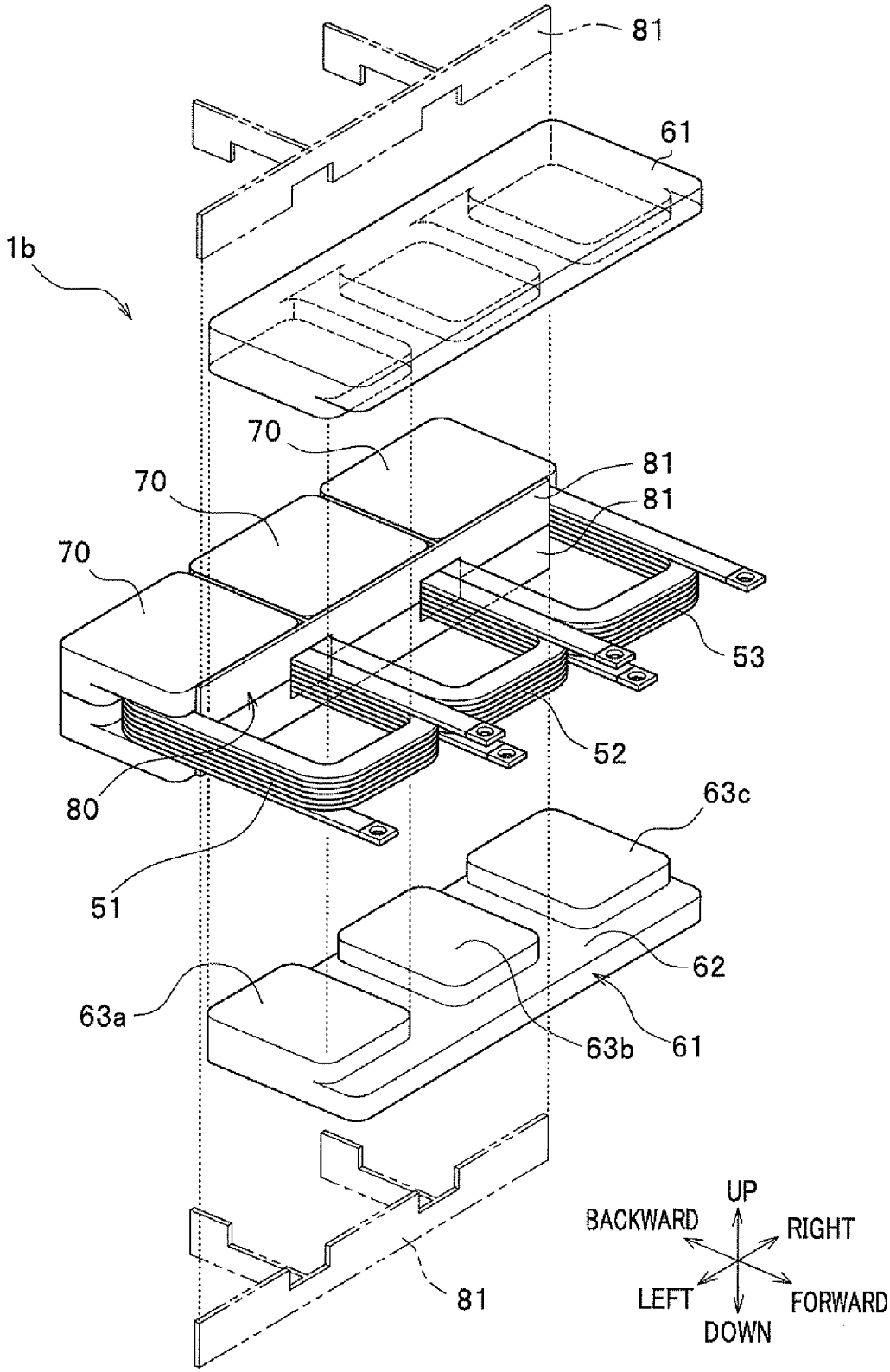
FIG. 6 is an exploded perspective view of the composite transformer illustrated in FIG. 5.
Figure 9:
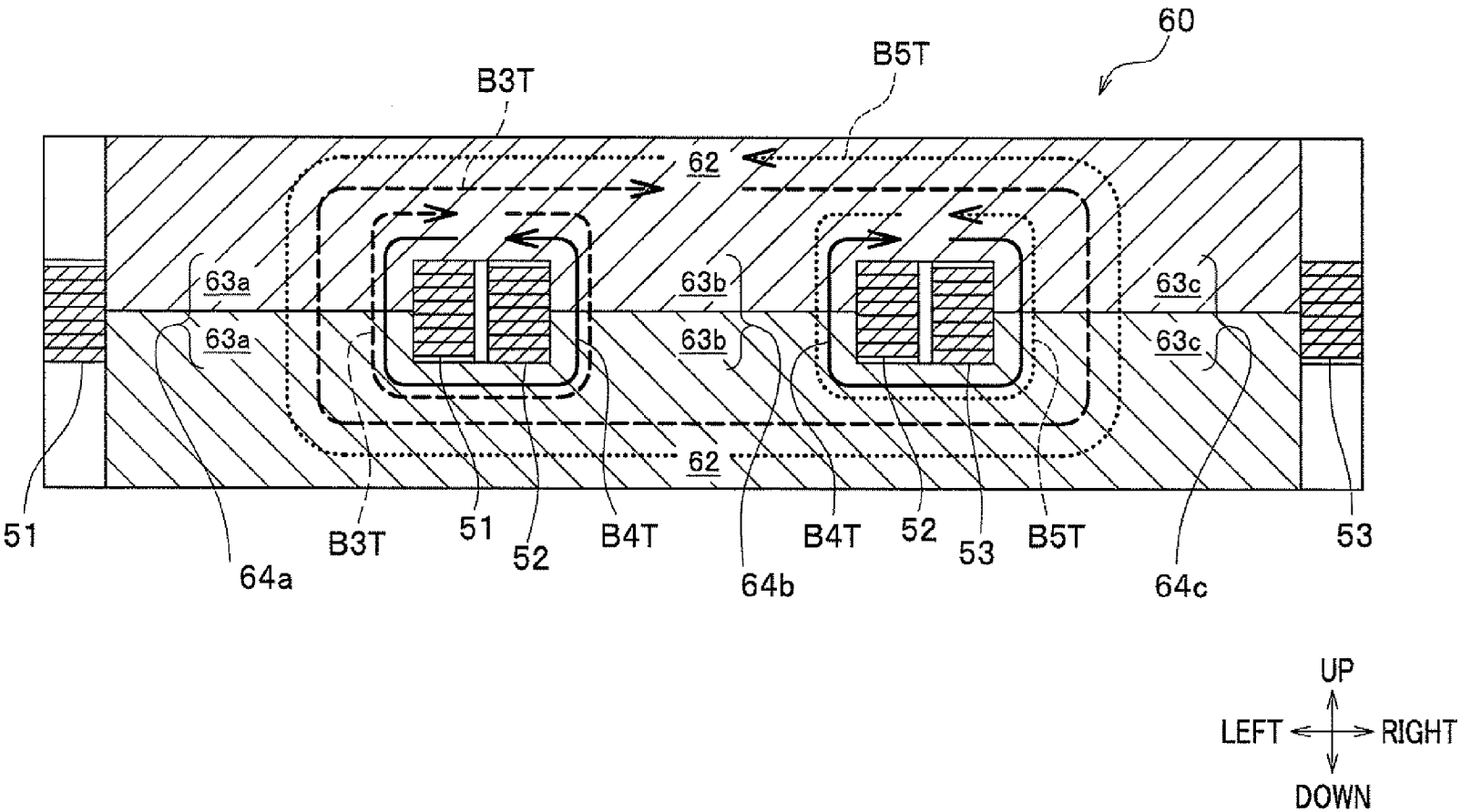
FIG. 9 is a cross-sectional view of the composite transformer illustrated in FIG. 5 at the cross section B-B.

The transformer core 60 includes three transformer-core legs 64 and a pair of transformer bases 62, through which a closed magnetic circuit can be formed as illustrated in FIG. 9. In addition, the transformer core 60 is formed by joining a pair of transformer-core members 61 having an identical shape as illustrated in FIG. 6. Further, as illustrated in FIG. 6, each transformer-core member 61 is integrally formed with one of the transformer base 62 and three transformer-core-leg portions 63*a*, 63*b*, and 63*c*. Each transformer base 62 has a platelike shape. Each of the three transformer-core-leg portions 63*a*, 63*b*, and 63*c* has a shape of a quadrangular prism and is formed on a flat surface of one of the transformer bases 62.

The transformer-core-leg portions 63*a*, 63*b*, and 63*c* are elements for constituting the three transformer-core legs 64, respectively. Each of the three transformer-core-leg portions 63*a*, 63*b*, and 63*c* constituting each transformer-core member 61 is formed as an extension of one of the transformer bases 62 constituting the transformer-core member 61 so as to have a shape of the prism (e.g., a rectangular shape in a cross-sectional view) as illustrated in FIG. 6. The transformer-core-leg portions 63*a*, 63*b*, and 63*c* are formed in this order from the left to the right on the flat surface of one of the transformer bases 62. In addition, the transformer-core-leg portions 63*a*, 63*b*, and 63*c* are so spaced that the three windings 50 can be wound around the transformer-core-leg portions 63*a*, 63*b*, and 63*c*, respectively.

Figure 8:
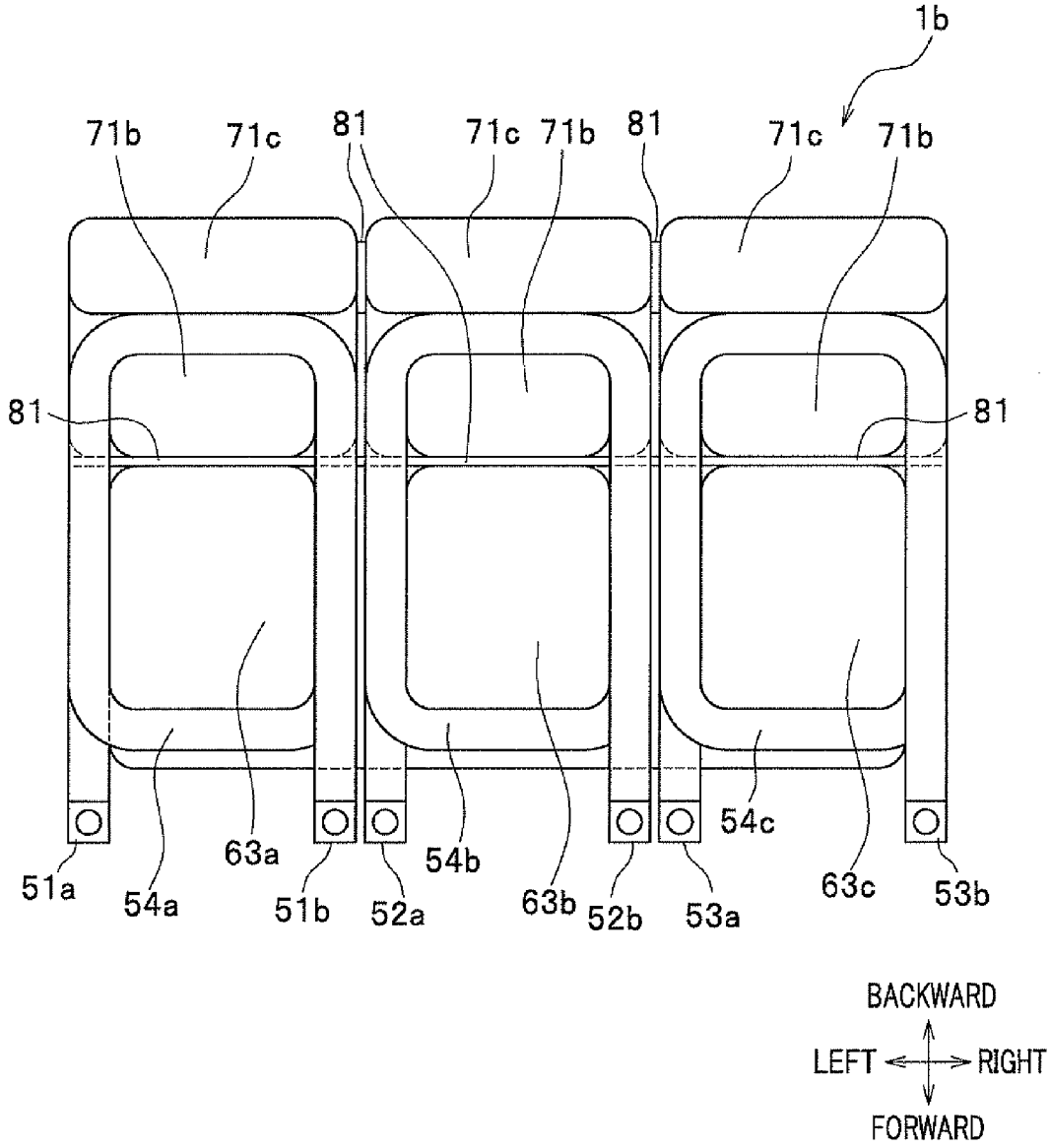
FIG. 8 is a top view of a portion of the composite transformer according to the second embodiment, where the transformer-core members and inductor-core members which are arranged at the top are removed for illustration.

The dimension of each of the transformer-core-leg portions 63*a*, 63*b*, and 63*c* in the left/right direction is approximately equal to the internal dimension of the corresponding one of the three windings 50 in the left/right direction as illustrated in FIG. 8. In addition, the dimension of each of the transformer-core-leg portions 63*a*, 63*b*, and 63*c* in the forward/backward direction is such that the sum of the dimension of an inductor-core-leg portion 71*b* (explained later) in the forward/backward direction, the thickness of the magnetic-insulation sheet 80, and the dimension of each of the transformer-core-leg portions 63*a*, 63*b*, and 63*c* in the forward/backward direction is approximately equal to the internal dimension of the corresponding one of the three windings 50 in the forward/backward direction.

The transformer core 60 having the three transformer-core legs 64 can be formed by arranging the pair of transformer-core members 61 in such positions that the top surfaces of the transformer-core-leg portions 63*a*, 63*b*, and 63*c* formed on one of the transformer bases 62 are respectively opposed to the top surfaces of the transformer-core-leg portions 63*a*, 63*b*, and 63*c* formed on the other of the transformer bases 62, making the opposed top surfaces of the transformer-core-leg portions 63*a*, 63*b*, and 63*c* abut each other, and joining the opposed ones of the transformer-core-leg portions 63*a*, 63*b*, and 63*c*.

In the following explanations, the transformer-core legs 64 arrayed from the left to the right may be respectively referred to as the first, second, and third transformer-core legs 64*a*, 64*b*, and 64*c*.

The first, second, and third windings 51, 52, and 53 are respectively wound around the first, second, and third transformer-core legs 64*a*, 64*b*, and 64*c*. The first, second, and third windings 51, 52, and 53 are wound in such directions that the magnetic fluxes produced by the first, second, and third windings 51, 52, and 53 are canceled in the closed magnetic circuits in the transformer core 60.

2.4 Inductor Cores 70

The composite transformer 1*b* according to the second embodiment includes the three inductor cores 70 respectively corresponding to the three windings 50.

Figure 7:
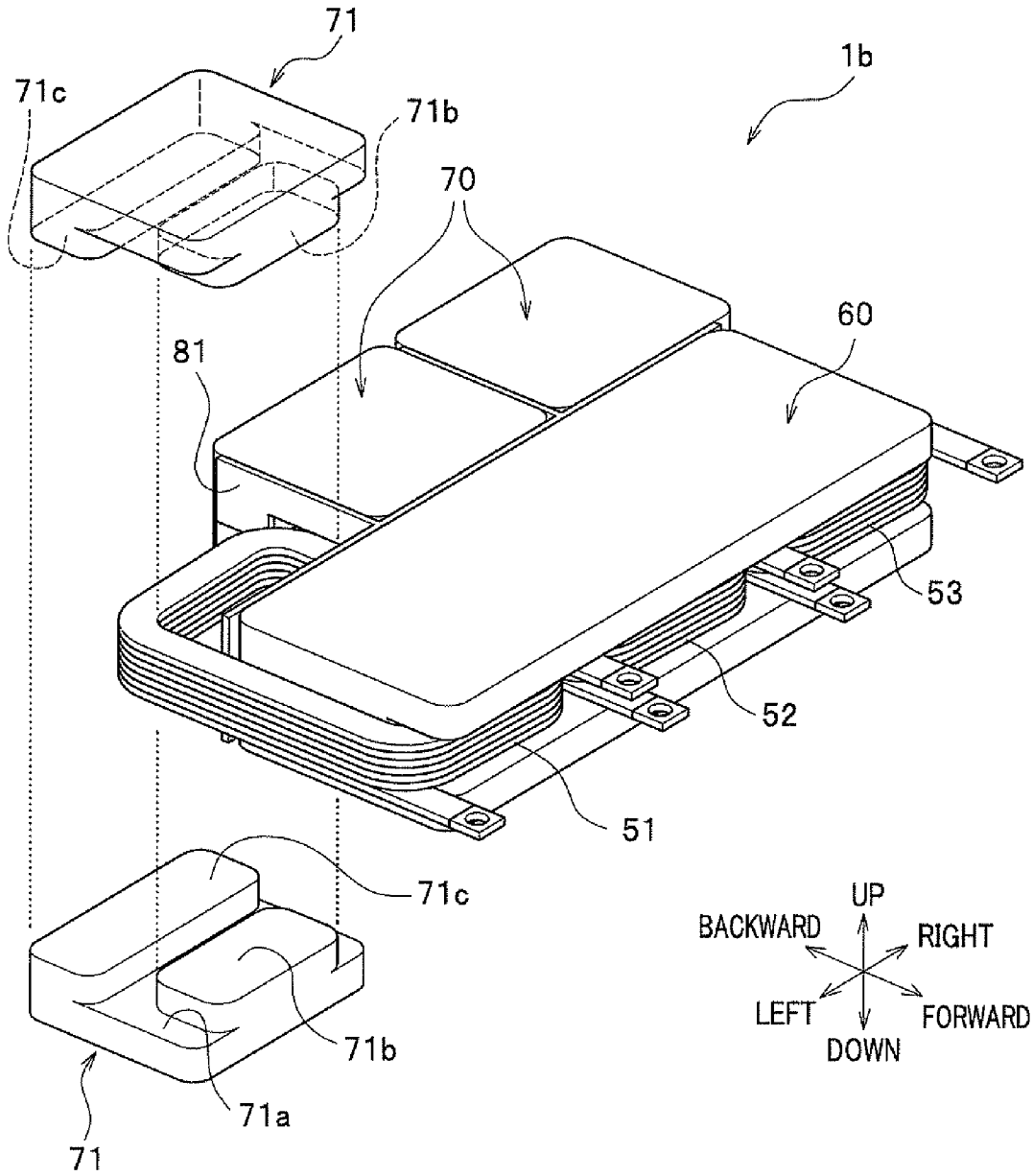
FIG. 7 is another exploded perspective view of the composite transformer illustrated in FIG. 5.

As illustrated in FIG. 10, the three inductor cores 70 each include an inductor-core leg 73, an outer core leg 74, and a pair of inductor bases 71*a*. The three windings 50 are respectively wound around the inductor-core legs 73 in the three inductor cores 70. A closed magnetic circuit can be formed through the inductor-core leg 73, the outer core leg 74, and the pair of inductor bases 71*a* in each of the three inductor cores 70. In addition, as illustrated in FIG. 7, each of the three inductor cores 70 is formed with a pair of inductor-core members 71. The structure of each inductor-core member 71 is explained below.

As illustrated in FIG. 7, each inductor-core member 71 is integrally formed with one of the inductor bases 71*a*, the aforementioned inductor-core-leg portion 71*b*, and an outer-core-leg portion 71*c*. The inductor base 71*a* has a platelike shape. The inductor-core-leg portion 71*b* is formed on the front (forward) side of the inductor base 71*a*, and the outer-core-leg portion 71*c* is formed on the rear (backward) side of the inductor base 71*a*.

Each inductor-core-leg portion 71*b* is formed as an extension of the inductor base 71*a* constituting one of the inductor-core members 71 so as to have a shape of a prism (e.g., a rectangular shape in a cross-sectional view) as illustrated in FIG. 8.

The dimension of each inductor-core-leg portion 71*b* in the left/right direction is approximately equal to the internal dimension of the corresponding one of the three windings 50 in the left/right direction as illustrated in FIG. 8. In addition, the dimension of each inductor-core-leg portion 71*b* in the forward/backward direction is such that the sum of the dimension of the inductor-core-leg portion 71*b* in the forward/backward direction, the thickness of the magnetic-insulation sheet 80, and the dimension of the corresponding one of the transformer-core-leg portions 63*a*, 63*b*, and 63*c* in the forward/backward direction is approximately equal to the internal dimension of the corresponding one of the three windings 50 in the forward/backward direction. Thus, the dimensions of each of the core legs 75 which is constituted by one of the inductor-core legs 73, a portion of the magnetic-insulation sheet 80, and one of the transformer-core legs 64 has dimensions approximately equal to the internal dimensions of the corresponding one of the three windings 50, so that the three windings 50 can be respectively wound around the core legs 75.

Each of the three inductor cores 70 having the inductor-core leg 73 and the outer core leg 74 can be formed by arranging the pair of inductor-core members 71 for constituting the inductor core 70 in such positions that the inductor-core-leg portions 71*b* in the opposed inductor-core members 71 are on the front (forward) side, and the outer-core-leg portions 71*c* in the opposed inductor-core members 71 are on the rear (backward) side, and the top surfaces of the inductor-core-leg portion 71*b* and the outer-core-leg portion 71*c* formed on one of the inductor bases 71*a* are respectively opposed to the top surfaces of the inductor-core-leg portion 71*b* and the outer-core-leg portion 71*c* formed on the other of the inductor bases 71*a*, and joining the opposed top surfaces of the inductor-core-leg portions 71*b* (on the front side) and the opposed top surfaces of the outer-core-leg portions 71*c* (on the rear side) in the inductor-core members 71.

2.5 Magnetic-Insulation Sheet 80

The magnetic-insulation sheet 80 is a sheet member having low magnetic permeability, and arranged between the transformer core 60 and the three inductor cores 70 as illustrated in FIG. 5. The magnetic-insulation sheet 80 is constituted by two magnetic-insulation-sheet members 81 which are inserted into the gaps between the transformer core 60 and the three inductor cores 70 and between the three inductor cores 70, from the upper and lower sides, respectively, as illustrated in FIG. 8.

2.6 Operations of Composite Transformer 1*b*

The operations of the composite transformer 1*b* are explained below.

In the following explanations, one of the core legs 75 around which the first winding 51 is wound is referred to as the first core leg 75*a*, the magnetic flux produced in the first core leg 75*a* when current flows through the first winding 51 is denoted by B3, the magnetic flux produced in the first transformer-core leg 64*a* as a portion of the magnetic flux B3 is denoted by B3T, and the magnetic flux produced in the corresponding one of the three inductor cores 70 as a portion of the magnetic flux B3 is denoted by B3L. In addition, one of the core legs 75 around which the second winding 52 is wound is referred to as the second core leg (not shown), the magnetic flux produced in the second core leg when current flows through the second winding 52 is denoted by B4, the magnetic flux produced in the second transformer-core leg 64*b* as a portion of the magnetic flux B4 is denoted by B4T, and the magnetic flux produced in the corresponding one of the three inductor cores 70 as a portion of the magnetic flux B4 is denoted by B4L. Further, one of the core legs 75 around which the third winding 53 is wound is referred to as the third core leg (not shown), the magnetic flux produced in the third core leg when current flows through the third winding 53 is denoted by B5, the magnetic flux produced in the third transformer-core leg 64*c* as a portion of the magnetic flux B5 is denoted by B5T, and the magnetic flux produced in the corresponding one of the three inductor cores 70 as a portion of the magnetic flux B5 is denoted by B5L.

First, the magnetic flux produced in the transformer core 60 when current flows in each of the first to third windings 51 to 53 is explained below.

When current flows through the first winding 51 in the direction from the connection terminal 51*a* to the connection terminal 51*b*, the magnetic flux B3T is produced in the first transformer-core leg 64*a* in the first core leg 75*a* (around which the first winding 51 is wound) as illustrated in FIG. 9. The magnetic flux B3T produced in the first transformer-core leg 64*a* is in the upward direction, and extends to the transformer base 62 located on the upper side. Since the transformer base 62 located on the upper side is connected to the second transformer-core leg 64*b* and the third transformer-core leg 64*c*, the magnetic flux B3T in the transformer base 62 extends to the second transformer-core leg 64*b* and the third transformer-core leg 64*c* in the transformer core 60. Then, the magnetic flux B3T in each of the second transformer-core leg 64*b* and the third transformer-core leg 64*c* returns to the first transformer-core leg 64*a* through the transformer base 62 on the lower side. Thus, the magnetic flux B3T circulates in magnetic circuits in the transformer core 60.

When current flows through the second winding 52 in the direction from the connection terminal 52*a* to the connection terminal 52*b*, the magnetic flux B4T is produced in the second transformer-core leg 64*b* in the second core leg (around which the second winding 52 is wound) as illustrated in FIG. 9. The magnetic flux B4T produced in the second transformer-core leg 64*b* is in the upward direction, and extends to the transformer base 62 located on the upper side. Since the transformer base 62 located on the upper side is connected to the first transformer-core leg 64*a* and the third transformer-core leg 64*c*, the magnetic flux B4T in the transformer base 62 extends to the first transformer-core leg 64*a* and the third transformer-core leg 64*c* in the transformer core 60. Then, the magnetic flux B4T in each of the first transformer-core leg 64*a* and the third transformer-core leg 64*c* returns to the second transformer-core leg 64*b* through the transformer base 62 on the lower side. Thus, the magnetic flux B4T circulates in magnetic circuits in the transformer core 60.

When current flows through the third winding 53 in the direction from the connection terminal 53*a* to the connection terminal 53*b*, the magnetic flux B5T is produced in the third transformer-core leg 64*c* in the third core leg (around which the third winding 53 is wound) as illustrated in FIG. 9. The magnetic flux B5T produced in the third transformer-core leg 64*c* is in the upward direction, and extends to the transformer base 62 located on the upper side. Since the transformer base 62 located on the upper side is connected to the first transformer-core leg 64*a* and the second transformer-core leg 64*b*, the magnetic flux B5T in the transformer base 62 extends to the first transformer-core leg 64*a* and the second transformer-core leg 64*b* in the transformer core 60. Then, the magnetic flux B5T in each of the first transformer-core leg 64*a* and the second transformer-core leg 64*b* returns to the third transformer-core leg 64*c* through the transformer base 62 on the lower side. Thus, the magnetic flux B5T circulates in magnetic circuits in the transformer core 60.

As explained above, when current flows in one of the three windings 50, electromagnetic induction occurs in the other two of the three windings 50. Therefore, the other two of the three windings 50 are boosted. Specifically, current flows through the other two of the three windings 50 in the directions from the corresponding two of the connection terminals 51*a*, 52*a*, and 53*a* (connected to the positive electrode) to the corresponding two of the connection terminals 51*b*, 52*b*, and 53*b* (connected to the negative electrode). Thus, the composite transformer 1*b* carries out the function of a transformer.

Next, the operations of the three inductor cores 70 when current flows through each of the first to third windings 51 to 53 are explained below.

The magnetic flux B3L which is produced in the inductor-core leg 73 in the first core leg 75*a* when current flows through the first winding 51 is in the upward direction, and extends to the outer core leg 74 through the inductor base 71*a* on the upper side. Since the magnetic flux B3L in the outer core leg 74 is in the downward direction, the magnetic flux B3L passes through the inductor base 71*a* on the lower side, and returns to the inductor-core leg 73. Thus, the magnetic flux B3L circulates in the corresponding one of the inductor cores 70.

As long as current flows through the first winding 51, the magnetic flux is produced in the corresponding one of the three inductor cores 70, i.e., magnetic energy is stored in the corresponding inductor core 70. That is, the first winding 51 and the corresponding inductor core 70 carry out the function of an inductor.

2.7 Advantages of Second Embodiment

The composite transformer 1*b* according to the second embodiment has the following advantages.

(1) Since the magnetic fluxes B3T, B4T, and B5T produced in the transformer core 60 by the first, second, and third windings 51, 52, and 53 are in mutually canceling directions as illustrated in FIG. 9. Therefore, it is possible to reduce the remanent magnetic flux in the transformer core 60, and prevent the magnetic saturation in the transformer core 60. In particular, the remanent magnetic flux (especially, the DC magnetic flux) can be reduced.

(2) Since the transformer-core leg 64 is provided in correspondence with each of the three windings 50, it is possible to prevent saturation of the magnetic flux in the transformer-core leg 64. Therefore, it is possible to avoid the situation in which the magnetic flux density realized by the magnetic flux produced by the three windings 50 exceeds the saturation magnetic flux density of the transformer core 60 and causes a magnetic energy loss.

(3) The magnetic paths constituting the closed magnetic circuits in the transformer core 60 and extending in the direction of the axes of the three windings 50 are in the transformer-core legs 64 (around which the three windings 50 are respectively wound). Therefore, no magnetic paths extending in the direction of the axes of the three windings 50, other than the transformer-core legs 64, are required to be provided, so that the composite transformer 1*b* can be realized in small size.

(4) The connection terminals 51*a* and 51*b* of the first winding 51, the connection terminals 52*a* and 52*b* of the second winding 52, and the connection terminals 53*a* and 53*b* of the third winding 53 are lead out from the composite transformer 1*b* in the identical direction, and arranged on the front (forward) side. Therefore, it is possible to arrange the wires connected the composite transformer 1*b*, on one side of the composite transformer 1*b*, and realize a DC-DC converter using the composite transformer 1*b* in small size.

3. Concrete Examples

Concrete examples of the composite transformers are explained below.

3.1 Concrete Examples 1

In each of the concrete examples 1, the composite transformer 1*a* according to the first embodiment of the present invention is arranged in a DC-DC converter, and the applied voltage is boosted by turning on and off a switching element in the DC-DC converter. The composite transformers in the concrete examples 1 respectively have different numbers of turns, and the volumes of the composite transformers have been measured. In addition, the values of the copper loss and the core loss (as the losses in the magnetic parts) in the composite transformers in the concrete examples 1 have been calculated for cases in which a predetermined voltage is applied to and a predetermined amount of current is passed through the composite transformers. The calculation conditions such as the applied voltage are indicated in Table 1.

TABLE 1

| Applied Voltage ($V_{in}$) | Input Current ($I_{in}$) | Output Power ($P_{out}$) | Switching Frequency ($f_{sw}$) | Ripple Current ($I_{pp}$) |
|---|---|---|---|---|
| 70 V | 150 A | 10.5 kW | 45 kHz | 17 A p-p |

In addition, in the composite transformers in the concrete examples 1, the transformer cores are made by using a ferrite material as a raw material, and the inductor cores are made by using permalloy dust as a raw material.

Figure 11A:
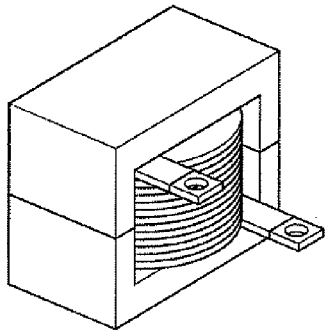
FIGS. 11A to 11D are perspective views of transformers or inductors used in comparison examples.
Figure 11B:
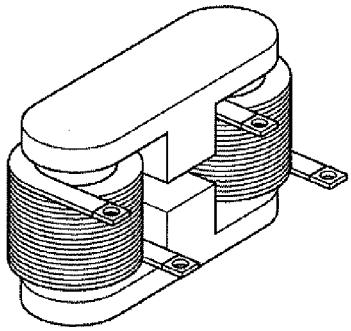
Figure 11C:
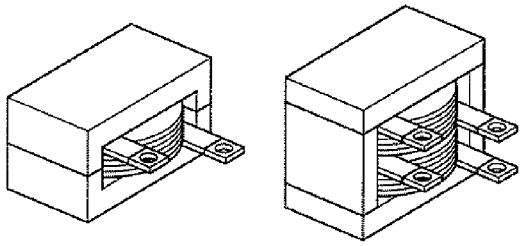
Figure 11D:
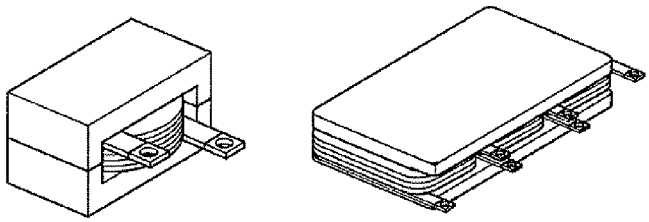

Further, in order to evaluate the results of the measurement of the composite transformers in the concrete examples 1, comparison examples 1 to 3 have been prepared. The comparison example 1 is a conventional inductor as illustrated in FIG. 11A, where the raw material of the inductor core is permalloy dust. The comparison example 2 is a loosely-coupled inductor as illustrated in FIG. 11B, where the raw material of the core is a ferrite material. The comparison example 3 is a combination of an L-type chopper and a magnetic-field canceling transformer as illustrated in FIGS. 11C and 11D, where the raw material of the core in the L-type chopper is permalloy dust, and the raw material of the core in the magnetic-field canceling transformer is a ferrite material.

Figure 12:
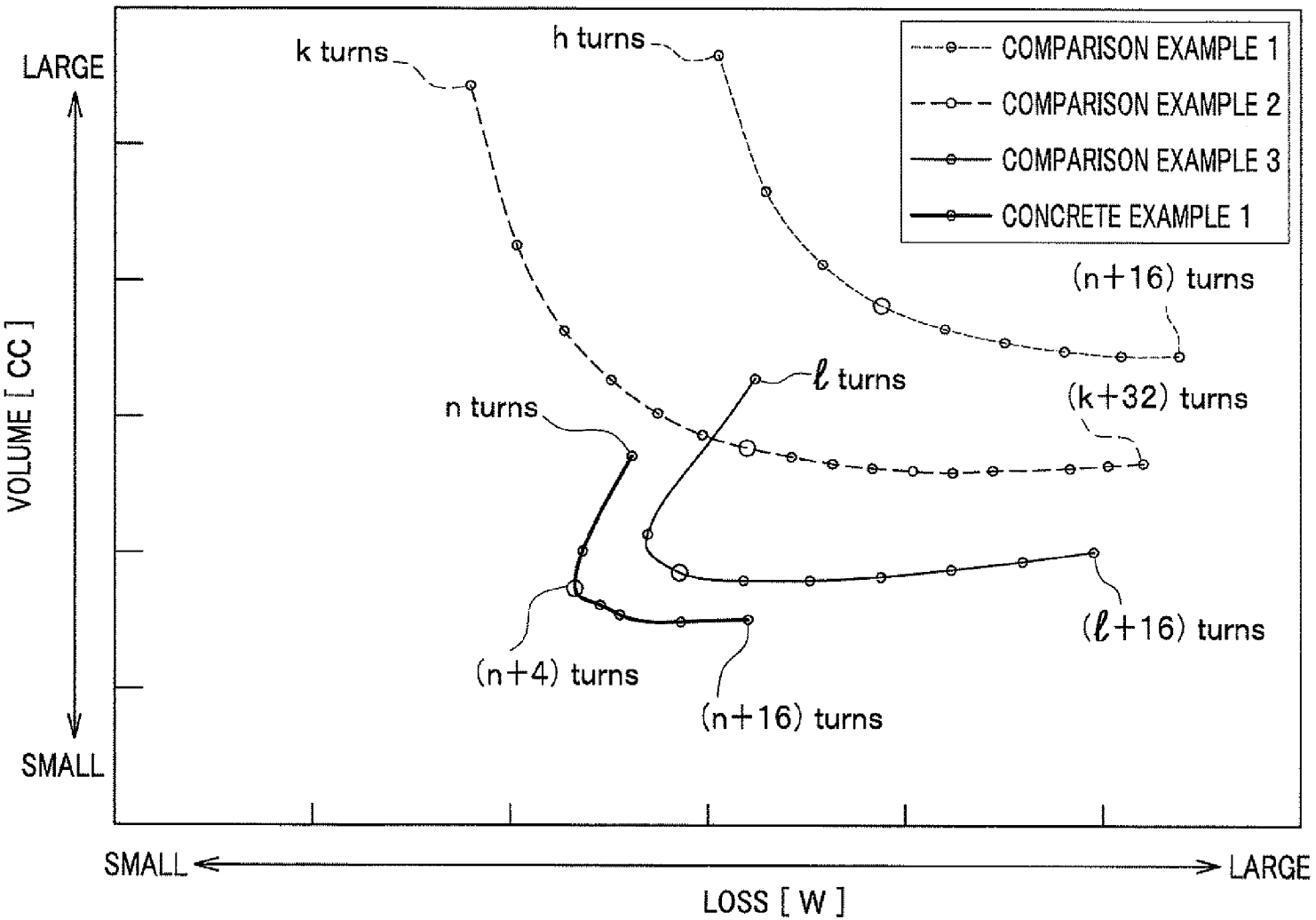
FIG. 12 is a graph indicating results of measurement of the volume and the magnetic energy loss in the concrete examples 1 and the comparison examples 1 to 3 with various numbers of turns.

In the concrete examples 1 and the comparison examples 1 to 3, identical windings are used. The results of the measurement and the calculation are indicated in FIG. 12, where the volumes are indicated in cubic centimeters (cc), and the loss is indicated in watt (W). In the graph of FIG. 12, the ordinate indicates the scale of the volume which increases in the upward direction, and the abscissa indicates the scale of the sum of the copper loss and the core loss which increases from the left to the right. Therefore, in FIG. 12, smaller devices are plotted on the lower side, and devices causing smaller losses are plotted in the left side.

The results of FIG. 12 indicate that the plotted data of the concrete examples 1 are distributed in the lower left area as a whole, compared with the comparison examples 1 to 3. That is, the results of FIG. 12 indicate that the first embodiment of the present invention can achieve downsizing and reduction in the magnetic energy loss.

3.2 Concrete Examples 2

In each of the concrete examples 2, the composite transformer 1*b* according to the second embodiment of the present invention is used. As in the concrete examples 1, the composite transformers in the concrete examples 2 respectively have different numbers of turns, and the volumes of the composite transformers have been measured. In addition, the values of the copper loss and the core loss (as the losses in the magnetic parts) in the composite transformers in the concrete examples 2 have been calculated for cases in which a predetermined voltage is applied to and a predetermined amount of current is passed through the composite transformers. The calculation conditions such as the applied voltage are indicated in Table 2.

TABLE 2

| Applied Voltage ($V_{in}$) | Input Current ($I_{in}$) | Output Power ($P_{out}$) | Switching Frequency ($f_{sw}$) | Ripple Current ($I_{pp}$) |
|---|---|---|---|---|
| 70 V | 500 A | 75 kW | 15 kHz | 75 A p-p |

In addition, in the composite transformers in the concrete examples 2, the transformer cores are made by using a ferrite material as a raw material, and the inductor cores are made by using permalloy dust as a raw material.

Figure 13:
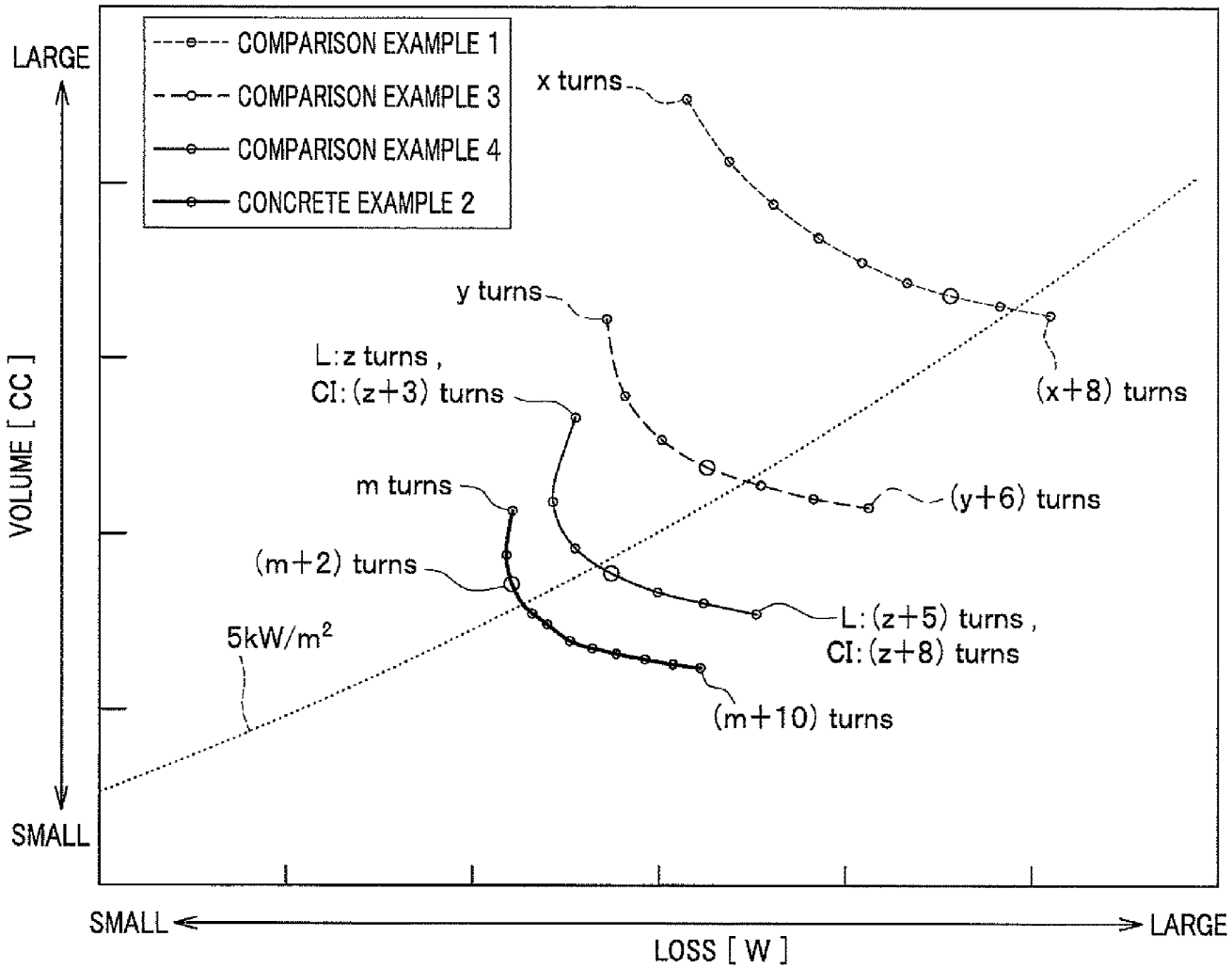
FIG. 13 is a graph indicating results of measurement of the volume and the magnetic energy loss in the concrete examples 2 and the comparison examples 1, 3, and 4 with various numbers of turns.

Further, in order to evaluate the results of the measurement of the composite transformers in the concrete examples 2, a further comparison example 4 have been prepared in addition to the comparison examples 1 and 3. The comparison example 4 is a combination of an inductor and a three-phase magnetic-field canceling transformer as illustrated in FIGS. 11E and 11F, where the raw material of the core in the inductor is permalloy dust, and the raw material of the core in the three-phase magnetic-field canceling transformer is a ferrite material. In the concrete examples 2 and the comparison examples 1, 3, and 4, identical windings are used. The results of the measurement and the calculation are indicated in FIG. 13, where the volumes are indicated in cubic centimeters (cc), and the loss is indicated in watt (W). In the graph of FIG. 13, the ordinate indicates the scale of the volume which increases in the upward direction, and the abscissa indicates the scale of the sum of the copper loss and the core loss which increases from the left to the right. Therefore, in FIG. 13, smaller devices are plotted on the lower side, and devices causing smaller losses are plotted in the left side. In other words, transformers plotted on the lower left area are superior.

The results of FIG. 13 indicate that the plotted data of the concrete examples 2 are distributed in the lower left area as a whole, compared with the comparison examples 1, 3, and 4. That is, the results of FIG. 13 indicate that the second embodiment of the present invention can achieve downsizing and reduction in the magnetic energy loss.

What is claimed is:

1. A combined type transformer comprising:

a plurality of windings;

a transformer core including a plurality of transformer-core legs which extend in a direction of axes of the plurality of windings and around which the plurality of windings are wound;

a plurality of inductor cores including a plurality of inductor-core legs which extend in the direction of the axes of the plurality of windings, around which the plurality of windings are wound, and each of which is arranged adjacent to one of the plurality of transformer-core legs in a direction perpendicular to the direction of the axes of the plurality of windings;

wherein a plurality of core legs are formed with the plurality of transformer-core legs and the plurality of inductor-core legs and the plurality of windings are wound around the plurality of core legs in such a manner that magnetic fluxes are produced in the plurality of transformer-core legs and the plurality of inductor-core legs when current flows through the plurality of windings, and the plurality of core legs and the plurality of windings form a single transformer and a plurality of inductors;

the plurality of transformer-core legs in the transformer core are arranged in an array in a direction perpendicular to the direction of the axes of the plurality of windings, the transformer core further includes a pair of transformer bases extending in the direction of the array and being opposed to each other and connected to both ends of each of the plurality of transformer-core legs in such a manner that closed magnetic circuits for magnetic fluxes produced in the plurality of transformer-core legs can be formed in the transformer core;

each of the plurality of inductor cores includes one of the plurality of inductor-core legs, an outer core leg, and a pair of inductor bases, the outer core leg extends parallel to the one of the plurality of inductor-core legs in the direction of the axes of the plurality of windings and is arranged on an outer side of one of the plurality of windings wound around the one of the plurality of inductor-core legs, and the pair of inductor bases are connected to both ends of the one of the plurality of inductor-core legs and to both ends of the outer core leg in such a manner that a closed magnetic circuit for a magnetic flux produced in the one of the plurality of inductor-core legs can be formed in said each of the plurality of inductor cores; and the plurality of windings are wound around the plurality of core legs in such directions that the magnetic fluxes produced in the plurality of transformer-core legs cancel each other in the closed magnetic circuits in the transformer core in any combination of directions that the magnetic fluxes produced.

2. The combined type transformer according to claim 1, wherein the plurality of windings have connection terminals connected to electrodes of an external electric circuit, and are formed and arranged in such a manner that the connection terminals of the plurality of windings are lead out to an identical side.

3. The combined type transformer according to claim 1, further comprising a magnetic insulation sheet inserted between the transformer core and the plurality of inductor cores.

4. The combined type transformer according to claim 1, wherein the transformer core is formed with an upper transformer-core member and a lower transformer-core member, the plurality of transformer-core legs are divided into upper parts and lower parts by a plane perpendicular to the direction of the axes of the plurality of windings, the upper transformer-core member is integrally formed with a first one of the pair of transformer bases arranged on an upper side and the upper parts of the plurality of transformer-core legs which are connected to the first one of the pair of transformer bases, and the lower transformer-core member is integrally formed with a second one of the pair of transformer bases arranged on a lower side and the lower parts of the plurality of transformer-core legs which are connected to the second one of the pair of transformer bases.

5. The combined type transformer according to claim 1: wherein the plurality of windings are a first winding and a second winding each of which is concentrically wound to form a cylindrically shape; the plurality of inductor cores are a first inductor core around which the first winding is wound and a second inductor core around which the second winding is wound; the plurality of transformer-core legs in the transformer core are a first transformer-core leg around which the first winding is wound and which has a semicylindrical shape and a second transformer-core leg around which the second winding is wound and which has a semicylindrical shape and extends parallel to the first transformer-core leg; the first inductor core includes a first inductor-core leg having a semicylindrical shape; the second inductor core includes a second inductor-core leg having a semicylindrical shape; a first core leg having a cylindrical shape is constituted by the first transformer-core leg and the first inductor-core leg which is arranged adjacent to the first transformer-core leg in a direction perpendicular to the direction of the axes of the plurality of windings; a second core leg having a cylindrical shape is constituted by the second transformer-core leg and the second inductor-core leg which is arranged adjacent to the second transformer-core leg in a direction perpendicular to the direction of the axes of the plurality of windings; and the first winding and the second winding are respectively wound around the first core leg and the second core leg in such a manner that a magnetic flux produced in the first transformer-core leg and a magnetic flux produced in the second transformer-core leg cancel each other in the closed magnetic circuits in the transformer core.

6. The combined type transformer according to claim 1: wherein the plurality of windings are a first winding, a second winding, and a third winding each of which is wound to form a rectangular shape; the plurality of inductor cores are a first inductor core around which the first winding is wound, a second inductor core around which the second winding is wound, and a third inductor core around which the third winding is wound; the plurality of transformer-core legs in the transformer core are a first transformer-core leg around which the first winding is wound and which has a rectangular shape, a second transformer-core leg around which the second winding is wound and which has a rectangular shape and extends parallel to the first transformer-core leg, and a third transformer-core leg around which the third winding is wound and which has a rectangular shape and extends parallel to the first transformer-core leg; the first inductor core includes a first inductor-core leg having a rectangular shape; the second inductor core includes a second inductor-core leg having a rectangular shape; the third inductor core includes a third inductor-core leg having a rectangular shape; a first core leg having a prismatic shape is constituted by the first transformer-core leg and the first inductor-core leg which is arranged adjacent to the first transformer-core leg in a direction perpendicular to the direction of the axes of the plurality of windings; a second core leg having a prismatic shape is constituted by the second transformer-core leg and the second inductor-core leg which is arranged adjacent to the second transformer-core leg in a direction perpendicular to the direction of the axes of the plurality of windings; a third core leg having a prismatic shape is constituted by the third transformer-core leg and the third inductor-core leg which is arranged adjacent to the third transformer-core leg in a direction perpendicular to the direction of the axes of the plurality of windings; and the first winding, the second winding, and the second winding are respectively wound around the first core leg, the second core leg, and the third core leg in such a manner that a magnetic flux produced in the first transformer-core leg, a magnetic flux produced in the second transformer-core leg, and a magnetic flux produced in the third transformer-core leg cancel each other in the closed magnetic circuits in the transformer core.

* * * * *